US009625111B2

(12) United States Patent
Zhang et al.

(10) Patent No.: US 9,625,111 B2
(45) Date of Patent: Apr. 18, 2017

(54) METHOD FOR FORMING LED BULB WITH HIGH INTERCHANGEABILITY AND UNIVERSALITY AND INTEGRATED LED BULB AND LAMP

(71) Applicant: GUIZHOU GZGPS CO., LTD, Guiyang, Guizhou (CN)

(72) Inventors: Jiqiang Zhang, Guizhou (CN); Zheyuan Zhang, Guizhou (CN)

(73) Assignee: GUIZHOU GZGPS CO., LTD., Guiyang, Guizhou (CN)

( * ) Notice: Subject to any disclaimer, the term of this patent is extended or adjusted under 35 U.S.C. 154(b) by 66 days.

(21) Appl. No.: 14/416,513

(22) PCT Filed: Jul. 23, 2013

(86) PCT No.: PCT/CN2013/000877

§ 371 (c)(1),
(2) Date: Jan. 22, 2015

(87) PCT Pub. No.: WO2014/015653

PCT Pub. Date: Jan. 30, 2014

(65) Prior Publication Data

US 2015/0247612 A1 Sep. 3, 2015

(30) Foreign Application Priority Data

Jul. 23, 2012 (CN) ..... 2012 1 0253546
Jul. 23, 2012 (CN) ..... 2012 1 0253599
(Continued)

(51) Int. Cl.
*F21K 9/90* (2016.01)
*F21S 8/08* (2006.01)
(Continued)

(52) U.S. Cl.
CPC ..... *F21S 8/085* (2013.01); *F21K 9/20* (2016.08); *F21K 9/64* (2016.08); *F21K 9/90* (2013.01);
(Continued)

(58) Field of Classification Search
CPC ..... F21V 17/06; F21V 29/50; F21V 29/70; F21V 29/74; F21V 15/01; F21V 31/00; F21K 9/135; F21K 9/30; F21S 8/00
See application file for complete search history.

(56) References Cited

FOREIGN PATENT DOCUMENTS

CN 201827857 U 5/2011
CN 202303052 U 7/2012
(Continued)

OTHER PUBLICATIONS

International Search Report dated Aug. 31, 2013 corresponding to application No. PCT/CN2013/000877.

*Primary Examiner* — Mary Ellen Bowman
(74) *Attorney, Agent, or Firm* — Nath, Goldberg & Meyer; Joshua B. Goldberg; Christopher Thomas

(57) ABSTRACT

The present invention provides a method for constructing an LED bulb (102) with high interchangeability and universality, an integral LED bulb (102) and a lamp. A silver paste printed circuit (4) is embedded on a heat conductive bracket (3) sintered by a nonmetal heat conductive material and provided with a cooling fin, and then an LED chip is welded on the silver paste printed circuit (4) or a drive chip is further welded thereon to form the LED bulb (102). The bulb may operate independently, so that the LED bulb (102), the lamp and a lighting control product are independently produced and used, which greatly reduces manufacturing links of LED lighting products, improves mass production and facilitates the industrialization of LED energy-saving lighting products.

15 Claims, 18 Drawing Sheets

(30) Foreign Application Priority Data

| | | |
|---|---|---|
| Jul. 23, 2012 | (CN) | 2012 1 0253600 |
| Jul. 23, 2012 | (CN) | 2012 1 0253769 |
| Jul. 23, 2012 | (CN) | 2012 1 0253805 |

(51) Int. Cl.

| | |
|---|---|
| ***F21V 21/30*** | (2006.01) |
| ***F21V 23/00*** | (2015.01) |
| ***F21V 3/04*** | (2006.01) |
| ***F21V 29/76*** | (2015.01) |
| ***F21V 29/74*** | (2015.01) |
| ***F21V 17/10*** | (2006.01) |
| ***F21V 19/00*** | (2006.01) |
| ***F21V 21/116*** | (2006.01) |
| ***F21K 9/20*** | (2016.01) |
| ***F21K 9/64*** | (2016.01) |
| *F21V 27/02* | (2006.01) |
| *F21W 131/103* | (2006.01) |
| *F21Y 101/00* | (2016.01) |

(52) U.S. Cl.

CPC ..... *F21S 8/086* (2013.01); *F21V 3/0481* (2013.01); *F21V 17/101* (2013.01); *F21V 19/0025* (2013.01); *F21V 21/116* (2013.01); *F21V 21/30* (2013.01); *F21V 23/002* (2013.01); *F21V 29/74* (2015.01); *F21V 29/763* (2015.01); *F21V 27/02* (2013.01); *F21W 2131/103* (2013.01); *F21Y 2101/00* (2013.01)

(56) References Cited

FOREIGN PATENT DOCUMENTS

| | | | |
|---|---|---|---|
| CN | 102777795 | A | 11/2012 |
| CN | 102777796 | A | 11/2012 |
| CN | 102818148 | A | 12/2012 |
| CN | 102818172 | A | 12/2012 |
| CN | 102818173 | A | 12/2012 |
| CN | 102818179 | A | 12/2012 |
| CN | 102818182 | A | 12/2012 |
| CN | 102829408 | A | 12/2012 |
| CN | 202647351 | U | 1/2013 |
| JP | 20113340 | A | 1/2011 |

METHOD FOR FORMING LED BULB WITH HIGH INTERCHANGEABILITY AND UNIVERSALITY AND INTEGRATED LED BULB AND LAMP

This is a National Phase Application filed under 35 U.S.C. 371 as a national stage of PCT/CN2013/000877, filed Jul. 23, 2013, an application claiming the benefit of Chinese Application No. 201210253546.9, filed Jul. 23, 2012, Chinese Application No. 201210253599.0, filed Jul. 23, 2012, Chinese Application No. 201210253805.8, filed Jul. 23, 2012, Chinese Application No. 201210253600.X, filed Jul. 23, 2012, and Chinese Application No. 201210253769.5, filed Jul. 23, 2012, the content of each of which is hereby incorporated by reference in its entirety.

FIELD OF THE INVENTION

The present invention relates to a method for constructing an LED bulb with high interchangeability and universality, an integral LED bulb and a lamp, which involve the field of LED lighting technology.

BACKGROUND OF THE INVENTION

As a new generation of lighting technology, LED semiconductor lighting has five energy-saving advantages incomparable by the existing other lighting technologies, such as high photoelectric conversion efficiency, easy control of light source direction, easy control of lighting time and manner, high light source color rendering property, and a high power factor under reasonable design, thus being warmly welcomed by worldwide investors and vigorously supported by the governments of all countries. The luminous efficiency of most current LED lamps may exceed 70 LM/W, thus having better energy saving advantages than the traditional energy saving lamps. The luminous efficiency of green LEDs may be up to 683 LM/W theoretically; the theoretical efficiency of white LED is also up to 182.45 LM/W, so the improvement space of LED lighting efficiency is huge.

In the current design of high power LED lighting products, especially high power LED lamps, due to heat dissipation, when a high power LED lamp is assembled, an LED light module, a driving power supply and a lamp are integrally designed, namely such components as the LED light module, the driving power supply and the lamp must be produced collectively, thus forming a situation of "LED having lamp while lacking bulb". This brings a series of fatal problems to the LED lighting products, such as high manufacturing cost, inconvenience for use, maintenance difficulty, and the like. First of all, national and even global uniform standardized production could not be achieved on manufacture, leading to numerous product specifications, few batches and high prices; second, the products of producers are varied, not universal, let alone interchangeable; third, the LED light module, the driving power supply, the lamp and the like need to be integrally detached for maintenance in the case of product failure, thus the maintenance is very inconvenient, and such defects as expanded failure, delayed maintenance and high maintenance cost and the like are very liable to form. These defects greatly restrict the popularization and use of LED lighting and are inherent problems in the popularization of the LED lighting products.

SUMMARY OF THE INVENTION

The object of the present invention is to provide a method for constructing a LED bulb with high interchangeability and universality, an integral LED bulb and a lamp. The bulb constructed by the method in the present invention may operate independently, and the LED bulb, the lamp and a lighting control product are independently produced and used, thereby greatly reducing manufacturing links of LED lighting products, improving mass production and facilitating the industrialization of LED energy-saving lighting products.

The technical solutions of the present invention are as follows: a method for constructing a universal LED bulb with high interchangeability and universality, including: embedding a silver paste printed circuit on a heat conductive bracket sintered by a nonmetal heat conductive material (alumina, aluminum nitride, boron nitride or the like may be adopted) and provided with a cooling fin, and then welding an LED chip, or further welding a drive chip on the silver paste printed circuit to form the LED bulb.

In the above-mentioned method for constructing the LED bulb with high interchangeability and universality, fluorescent powder is spray coated on the LED chip, and transparent silica gel is covered thereon, namely, the traditional package manner, with no bulb inner cover being adopted; or the number of the LED chips is configured according to the proportion of blue and red lights necessary for plants, and only the transparent silica gel is covered on the welded LED chip for package, and the LED bulb may be applied to agricultural production lighting.

In the above-mentioned method for constructing the LED bulb with high interchangeability and universality, a bulb inner cover is fixed to the heat conductive bracket by providing a slot, and the LED chip and the drive chip are wrapped in the bulb inner cover.

In the foregoing method for constructing the universal LED bulb with high interchangeability and universality, a bulb outer cover or a lens snap ring and a lens are further fixed to the heat conductive bracket by providing the slot, and a flange structure for installation is further sintered on the heat conductive bracket; or the heat conductive bracket is fixed in the bulb outer cover provided with an installation flange; or the heat conductive bracket is fixed in a lens bracket provided with a hang lug, and the lens is provided at the lower end of the lens bracket.

In the foregoing method for constructing the LED bulb with high interchangeability and universality, the bulb outer diameter D (i.e., the diameter of the flange of the heat conductive bracket) of the LED bulb and power W of the constructed LED bulb satisfy a relationship $W=1.1812e^{0.0361D}$, discrete numerical values are selected for D on the relationship curve $W=1.1812e^{0.0361D}$ to construct a plurality of LED bulbs with fixed bulb outer diameters D, in order to improve the interchangeability and universality of the LED bulbs. The discrete numerical values on the curve are selected for decreasing the number of the selected sizes while achieving high interchangeability and universality.

In the foregoing method for constructing the universal LED bulb with high interchangeability and universality, on the relationship curve $W=1.1812e^{0.0361D}$, with 20 mm used as the lower limit of the bulb outer diameter D and 130 mm used as the upper limit, the relationship curve is divided into 12 segments each of which is set to 10 mm to form limited bulb outer diameter specifications, and the interchangeability and universality of the LED bulbs are further improved by the small amount of bulb outer diameter specifications; 6 flange fixing holes on the heat conductive bracket with the flange are uniformly distributed at a diameter D1, and the diameter D1 is a value obtained by subtracting a diameter of a fixing screw cap and then subtracting a margin of 0.8-4 mm from the bulb outer diameter D; the diameter D2 of an installation interface opening of the LED bulb on a lamp is a value obtained by subtracting two times of a diameter of a fixing screw cap and then subtracting two times of the margin corresponding to the diameter D1 from the bulb outer diameter D. The installation interface of the LED bulb includes a surface in contact with the LED bulb and a hole connected to the LED bulb, on the lamp.

In the foregoing method for constructing the LED bulb with high interchangeability and universality, fluorescent powder is coated on an inner side of the bulb inner cover, and the LED chip is only packaged by the transparent silica gel, this structure ensures the fluorescent powder has better uniformity compared with that being directly sprayed on the chip, the fluorescent powder is away from the LED heating chip, the LED chip may operate at a relatively higher temperature, thereby perfecting the LED operation condition, effectively reducing the luminous decay of the LED bulb and ensuring a better LED light emission effect, and the dosage of the fluorescent powder is not increased to a larger extent; or the bulb inner cover is a concave inner cover made of an elastic material, the concave inner cover is of a concave structure in which transparent insulating heat conductive liquid is filled, a fluorescent material is provided in the transparent insulating heat conductive liquid, and the LED chip is packaged with no silica gel. In this structure, when the LED is electrified to generate heat, the transparent insulating heat conductive liquid is heated to flow to take away the heat of the LED chip, in order to exchange the heat with the radiator on a larger area, thus avoiding local high heat of the LED chip and the surrounding fluorescent powder in the traditional solution and effectively reducing the generation of LED luminous decay, when the transparent insulating heat conductive liquid is heated to expand, the concave inner cover protrudes outwards to increase the volume for receiving the expanded liquid, in order to avoid expanding of the liquid to result in ineffective seal of the inner cover.

In the foregoing method for constructing the LED bulb with high interchangeability and universality, the slot is provided to the heat conductive bracket, the bulb outer cover is directly embedded in the slot by adhesion, or the lens snap ring clamps the lens and the lens snap ring is embedded in the slot by adhesion.

An integral LED bulb achieving the foregoing method, including a heat conductive bracket provided with a cooling fin, wherein a silver paste printed circuit is embedded on the heat conductive bracket, and an LED chip is welded on the silver paste printed circuit, or a drive chip is further welded thereon.

In the foregoing integral LED bulb, fluorescent powder is spray-coated on the LED chip, and transparent silica gel is covered outside the fluorescent powder; or only transparent silica gel is covered on the LED chip.

In the foregoing integral LED bulb, a slot is provided to the heat conductive bracket, a bulb inner cover is embedded and fixed in the slot, and the bulb inner cover covers the LED chip and the drive chip.

In the foregoing integral LED bulb, the edge of the heat conductive bracket is of an installation flange structure, a slot is further provided outside the bulb inner cover, a bulb outer cover or a lens snap ring and a lens are further embedded in the slot; or the heat conductive bracket is fixed in the bulb outer cover provided with an installation flange; or the heat conductive bracket is fixed in a lens bracket provided with a hang lug, and the lens is provided at the lower end of the lens bracket.

In the foregoing integral LED bulb, only transparent silica gel for package is provided outside the LED chip, the bulb inner cover is provided outside the LED chip with the transparent silica gel and the drive chip, and fluorescent powder coating is provided to the inner layer of the bulb inner cover; or, the LED chip is packaged with no silica gel, a concave inner cover filled with transparent insulating heat conductive liquid is provided outside the LED chip, the LED chip is soaked in the transparent insulating heat conductive liquid, the fluorescent material is provided in the transparent insulating heat conductive liquid, and the concave inner cover is an elastic inner cover of a thin concave structure.

In the foregoing integral LED bulb, the slot is provided to the heat conductive bracket, the bulb outer cover is directly embedded in the slot by adhesion, or the lens snap ring clamps the lens and the lens snap ring is embedded in the slot by adhesion.

On another aspect, the present invention further provides a variety of lamps using the foregoing LED bulb. The lamp provided by the present invention is simple in structure, low in manufacturing cost, quick, cheap and convenient to install, use and maintain and is unlikely to expand failure, achieves independent production and use of the bulb, lamp and the lighting control product of the LED bulb, greatly reduces manufacturing links, achieves mass production and facilitates the application and the industrial scale of the LED energy-saving lighting products.

An oval LED street lamp using an installation interface bracket structure, including an installation interface plate fixing bracket, wherein an installation interface plate is provided at the lower part of the installation interface plate fixing bracket, an installation interface is provided to the installation interface plate, and an LED bulb is provided to the installation interface; the installation interface plate fixing bracket is connected to a lamp post; a lamp housing is provided at the upper part of the installation interface plate fixing bracket, a lampshade is provided outside the installation interface plate, and the lamp housing matches with the lampshade to form an oval shape.

In the foregoing oval LED street lamp using the installation interface bracket structure, a wire harness connector is provided to the installation interface plate fixing bracket, and the wire harness connector is used for connecting a plurality of LED bulbs to a power supply and a control circuit.

In the foregoing oval LED street lamp using the installation interface bracket structure, the installation interface plate fixing bracket includes a sleeve, wherein the sleeve is used for installing the lamp post, wire harness connector brackets are provided at both sides of the sleeve, and the wire harness connector brackets are used for installing the wire harness connector; a ring plate is provided outside the sleeve and the wire harness connector brackets, and the ring plate is used for fixedly connecting the installation interface plate to the installation interface plate fixing bracket.

In the foregoing oval LED street lamp using the installation interface bracket structure, a light penetration hole and a water drainage hole are provided on the lamp cover; the installation interface includes a surface in contact with the LED bulb and a hole connected to the LED bulb, on the installation interface plate.

In the foregoing oval LED street lamp using the installation interface bracket structure, a radiator interface opening and 6 flange fixing holes are provided to the installation interface of the installation interface plate, the flange fixing holes are used for fixing an LED bulb, and the radiator interface opening is used for enabling the LED bulb to penetrate through the installation interface; the flange fixing holes are uniformly distributed at a diameter D1, and the diameter D1 is a value obtained by subtracting a diameter of a fixing screw cap and then subtracting a margin of 0.8-4 mm from the outer diameter D of the LED bulb 102; the diameter D2 of the radiator interface opening on the installation interface is a value obtained by subtracting two times of a diameter of a fixing screw cap and then subtracting two times of the margin corresponding to the diameter D1 from the outer diameter D of the bulb.

An LED street lamp using a lamp housing as an installation interface bracket structure includes the lamp housing punch formed by sheet metal via a stamping process, an installation interface is provided to the lamp housing, an LED bulb is provided to the installation interface, the lamp housing is fixed to a lamp post by a lamp post fixing element, and a decorative cover is provided to the lamp housing.

The foregoing LED street lamp using the lamp housing as the installation interface bracket structure further includes a wire harness connector, wherein the wire harness connector is provided to the decorative cover, and the wire harness connector is used for connecting a plurality of LED bulbs to a power supply and a control circuit.

In the foregoing LED street lamp using the lamp housing as the installation interface bracket structure, the lamp housing is elliptic, edgefolds for reinforcing the structural strength are provided at the inner and outer edges of the lamp housing, and the installation interface includes a surface in contact with the LED bulb and a hole connected to the LED bulb, on the lamp housing.

In the foregoing LED street lamp using the lamp housing as the installation interface bracket structure, the lamp post fixing element includes a lamp post fixing bracket, a lamp post fixing bracket bolt and a reinforcing plate, wherein the lamp post fixing bracket and the reinforcing plate are provided at the upper and lower sides of the lamp housing, and the lamp housing is fixed to the lamp post through the lamp post fixing bracket and the reinforcing plate.

In the foregoing oval street lamp using the lamp housing as the installation interface bracket structure, a radiator interface opening and 6 flange fixing holes are provided to the installation interface of the lamp housing, the flange fixing holes are used for fixing the LED bulb, and the radiator interface opening is used for enabling the LED bulb to penetrate through the installation interface; the flange fixing holes are uniformly distributed at a diameter D1, and the diameter D1 is a value obtained by subtracting a diameter of a fixing screw cap and then subtracting a margin of 0.8-4 mm from the outer diameter D of the LED bulb; the diameter D2 of the radiator interface opening on the installation interface is a value obtained by subtracting two times of a diameter of a fixing screw cap and then subtracting two times of the margin corresponding to the diameter D1 from the outer diameter D of the bulb.

An LED street lamp using a lamp housing as an installation interface bracket structure includes a lamp housing punch-formed by sheet metal; the lamp housing includes a bracket panel folded to multiple pieces, an installation interface is provided to the bracket panel, and an LED bulb is provided to the installation interface; the lamp housing is fixed to a lamp post through a lamp post fixing element.

The foregoing LED street lamp using the lamp housing as the installation interface bracket structure further includes a wire harness connector, wherein the wire harness connector is provided to the lamp housing, and the wire harness connector is used for connecting a plurality of LED bulbs to a power supply and a control circuit.

In the foregoing LED street lamp using the lamp housing as the installation interface bracket structure, an edgefold for reinforcing the structural strength is provided at the edge of the lamp housing, and the installation interface includes a surface in contact with the LED bulb and a hole connected to the LED bulb, on the lamp housing; a lamp post fixing hole used for connecting the lamp post is formed in the upper part of the lamp post fixing bracket.

In the foregoing LED street lamp using the lamp housing as the installation interface bracket structure, the lamp post fixing element includes a lamp post fixing bracket, a lamp post fixing bracket bolt and a reinforcing plate, wherein the lamp post fixing bracket and the reinforcing plate are provided at the upper and lower sides of the lamp housing, and the lamp housing is fixed to the lamp post through the lamp post fixing bracket and the reinforcing plate; the lamp housing includes three bracket panels which are folded to form an angle, a planar bracket is provided at the lower part of the lamp post fixing bracket, and the lamp post fixing bracket is fixed to the bracket panel at the center of the lamp housing from the upper side or the lower side of the lamp housing; or, the lamp housing includes two bracket panels which are folded to form an angle, the lamp post fixing bracket is fixed to the bracket panels provided to form the angle from the upper side or the lower side of the lamp housing, and a triangular bracket is provided at the lower part of the lamp post fixing bracket and is inverted V-shaped or V-shaped.

In the foregoing LED street lamp using the lamp housing as the installation interface bracket structure, 6 flange fixing holes and a radiator interface opening are provided to the installation interface, the flange fixing holes are used for fixing the LED bulb, and the radiator interface opening is used for enabling the LED bulb to penetrate through the installation interface; the 6 flange fixing holes are uniformly distributed at a diameter D1, and the diameter D1 is a value obtained by subtracting a diameter of a fixing screw cap and then subtracting a margin of 0.8-4 mm from the outer diameter D of the LED bulb; the diameter D2 of the radiator interface opening is a value obtained by subtracting two times of a diameter of a fixing screw cap and then subtracting two times of the margin corresponding to the diameter D1 from the outer diameter D of the bulb.

An LED street lamp using an extrusion type installation interface bracket structure, including a metal extrusion type installation interface bracket, wherein the extrusion type installation interface bracket is fixed to a lamp post; the extrusion type installation interface bracket includes a lamp post fixing sleeve, bracket panels are provided on both sides of the lamp post fixing sleeve, and an installation interface used for installing an LED bulb is provided to each bracket panel; the LED bulb is installed on the installation interface.

The foregoing LED street lamp using the extrusion type installation interface bracket structure further includes a wire harness connector, wherein the wire harness connector is provided to the lamp post fixing sleeve, and the wire harness connector is used for connecting a plurality of LED bulbs to a power supply and a control circuit.

In the foregoing LED street lamp using the extrusion type installation interface bracket structure, in the extrusion type installation interface bracket, the bracket panels on both sides are provided to form an angle; a lamp post seal head is provided at one end of the lamp post fixing sleeve, and the other end of the lamp post fixing sleeve is fixed to the lamp post through a lamp post fixing screw; the installation interface includes a surface in contact with the LED bulb and a hole connected to the LED bulb, on the bracket panels.

In the foregoing LED street lamp using the extrusion type installation interface bracket structure, a radiator interface opening and 6 flange fixing holes are provided to the installation interface, the flange fixing holes are used for fixing the LED bulb, and the radiator interface opening is used for enabling the LED bulb to penetrate through the installation interface; the 6 flange fixing holes are uniformly distributed at a diameter D1, and the diameter D1 is a value obtained by subtracting a diameter of a fixing screw cap and then subtracting a margin of 0.8-4 mm from the outer diameter D of the LED bulb; the diameter D2 of the radiator interface opening is a value obtained by subtracting two times of a diameter of a fixing screw cap and then subtracting the margin corresponding to the diameter D1 from the outer diameter D of the bulb.

Compared with the prior art, in the present invention, the heat conductive bracket with the cooling fin is directly sintered by the nonmetal heat conductive material, and the LED silver paste printed circuit is directly embedded in the heat conductive bracket, such that the structure of the constructed LED bulb is simpler and more compact, and the heat dissipation of the LED is faster. Due to the arrangement of the slot on the heat conductive bracket, the lampshade is convenient to install and the water resistance is good. Moreover, the installation structure of the bulb may be directly sintered on the heat conductive bracket, or the heat conductive bracket is installed in a lampshade assembly with an installation structure. The integral LED bulb in the present invention is used for establishing the lamp in a simple, easy, flexible and variable manner, in this way, the bulb, the lamp and the lighting control product of the LED bulb are independently produced and used, thereby greatly reducing manufacturing links of LED lighting products, improving mass production and facilitating the industrialization of LED energy-saving lighting products.

Figure 1:
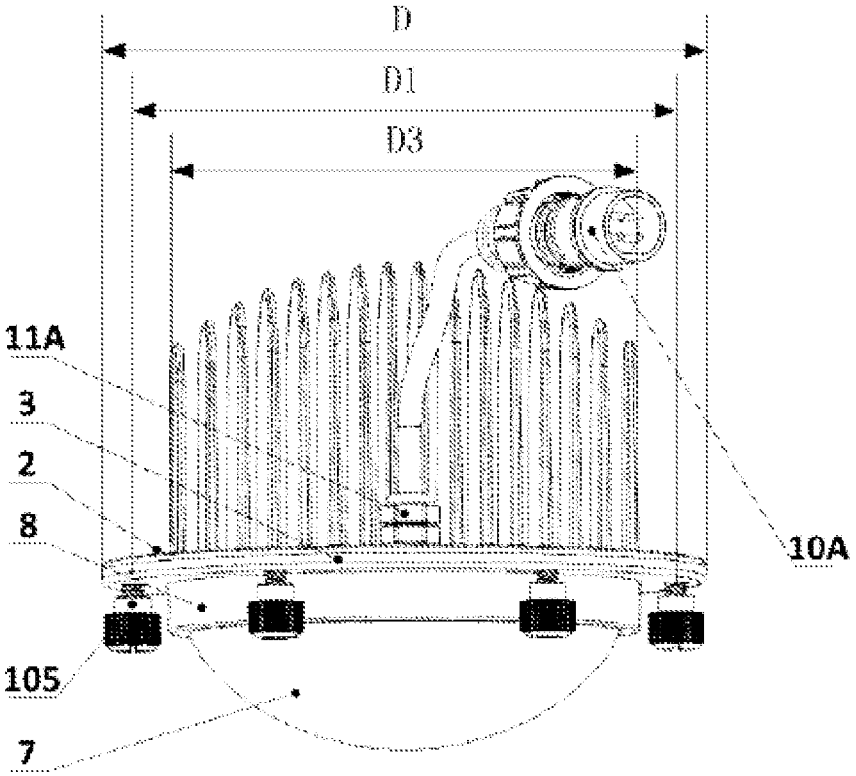
FIG. 1 is a schematic diagram of an outline of a lens solution of a first LED bulb in the present invention.
Figure 2:
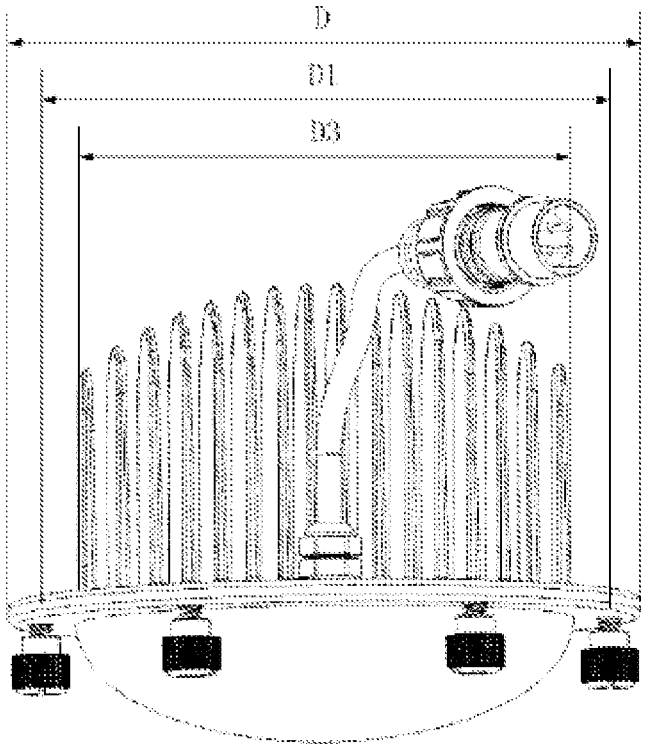
FIG. 2 is a schematic diagram of an outline of a bulb outer cover solution of the first LED bulb in the present invention.

Reference numerals: 3—heat conductive bracket, 4—silver paste printed circuit, 6—bulb inner cover, 61—concave inner cover, 7—lens, 8—lens snap ring, 71—lens bracket, 9—bulb outer cover, 91—bulb outer cover with installation flange, 10A—waterproof joint with cable, 11A—cable fixing head, 18—slot, 22—connector fixing hole, 101—lamp housing, 102—LED bulb in the present invention, 103—ceiling lamp head plate, and 105—bulb fixing screw.

DETAILED DESCRIPTION OF THE EMBODIMENTS

The present invention will be further illustrated below in conjunction with accompanying drawings and embodiments, which are not used as a basis of limiting the present invention.

Embodiments

A method for constructing an LED bulb with high interchangeability and universality, including: embedding a silver paste printed circuit on a heat conductive bracket sintered by a nonmetal heat conductive material (alumina, aluminum nitride, boron nitride or the like may be adopted) and provided with a cooling fin, and then welding an LED chip (including other related drive chip elements) on the silver paste printed circuit to form the LED bulb. A bulb inner cover is fixed to the heat conductive bracket by providing a slot, and the LED chip and the drive chip are wrapped in the bulb inner cover. A bulb outer cover or a lens is further fixed to the heat conductive bracket by providing the slot, and a flange structure for installation is further sintered on the heat conductive bracket; or the heat conductive bracket is fixed in the bulb outer cover provided with an installation flange; or the heat conductive bracket is fixed in a lens bracket provided with a hang lug, and the lens is provided at the lower end of the lens bracket. Fluorescent powder is coated on the inner side of the bulb inner cover, and the LED chip is only packaged with the transparent silica gel; or the bulb inner cover is a concave inner cover made of an elastic material, the concave inner cover is of a concave structure in which transparent insulating heat conductive liquid is filled, a fluorescent material is provided in the transparent insulating heat conductive liquid, and the LED chip is packaged with no silica gel. The LED chip may also be packaged by adopting a traditional package solution, namely, fluorescent powder is spray coated on the LED chip and transparent silica gel is covered thereon, and no bulb inner cover is used. When the present invention is applied to agricultural production lighting, the number of the LED chips is configured according to the proportion of blue and red lights necessary for plants, and only the transparent silica gel is covered on the welded LED chip for package. The slot is provided to the heat conductive bracket, the bulb outer cover is directly embedded in the slot by adhesion, or the lens snap ring clamps the lens and the lens snap ring is embedded in the slot by adhesion.

Figure 3:
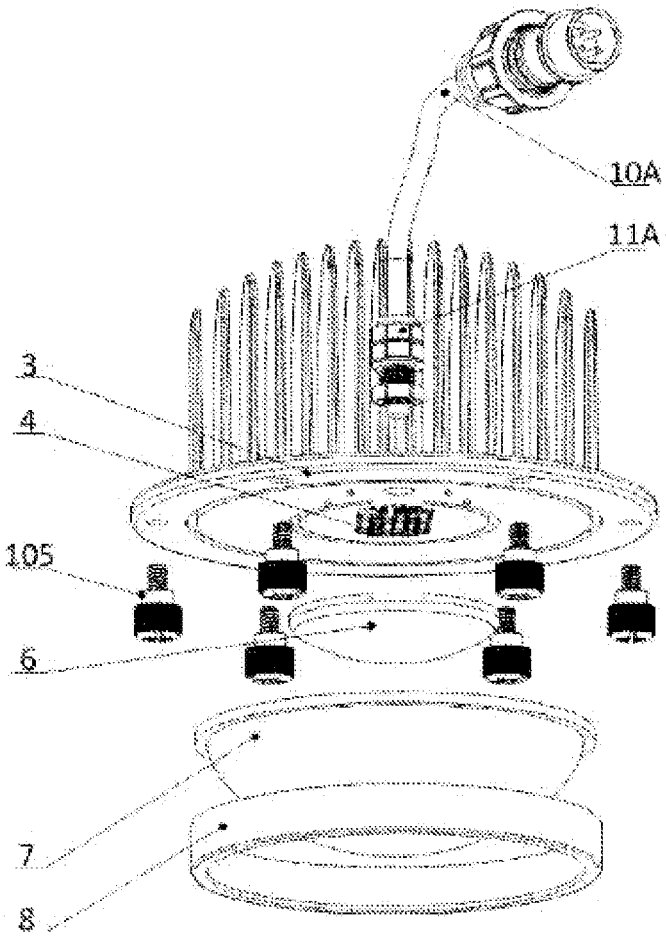
FIG. 3 is a schematic diagram of a structure of the lens solution of the first LED bulb in the present invention.
Figure 4:
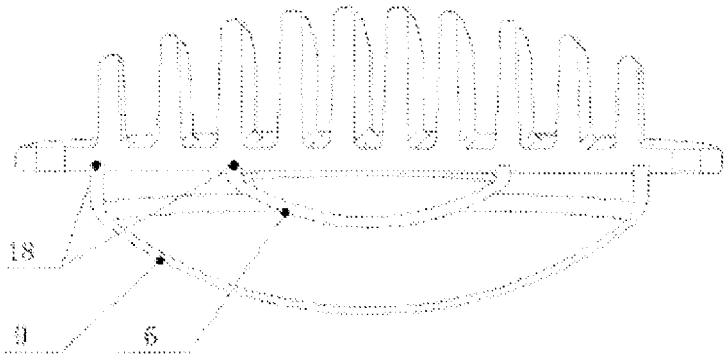
FIG. 4 is a schematic diagram of a structure of the bulb outer cover solution of the first LED bulb in the present invention.
Figure 5:
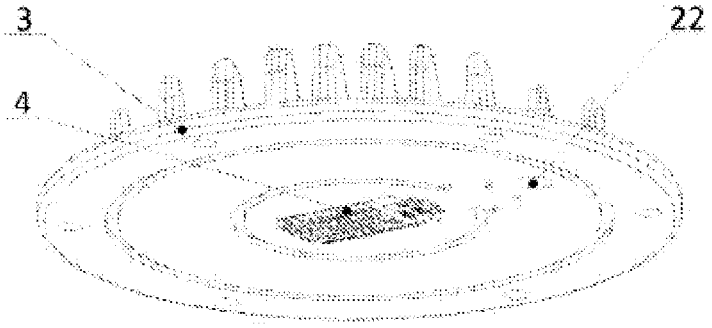
FIG. 5 is a schematic diagram of a structure of an embedding circuit of a heat conductive bracket in the present invention.
Figure 6:
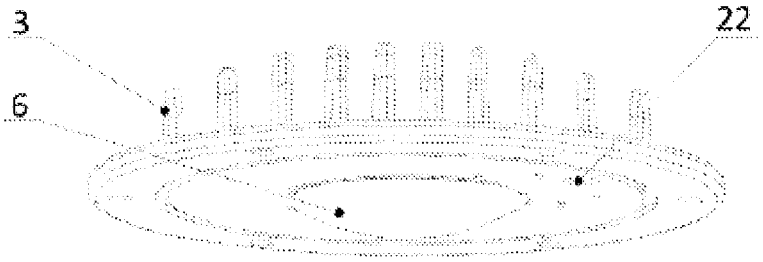
FIG. 6 is a schematic diagram of a structure of a heat conductive bracket with a bulb inner cover in the present invention.
Figure 7:
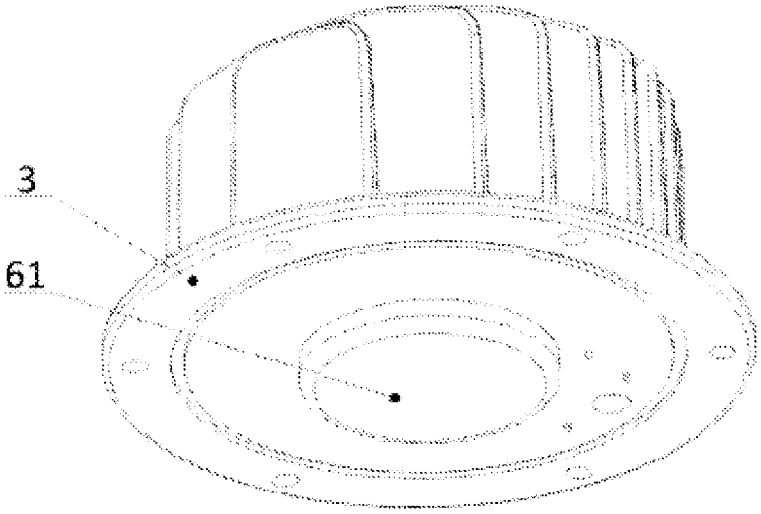
FIG. 7 is a schematic diagram of a structure of a heat conductive bracket with a concave inner cover in the present invention.
Figure 8:
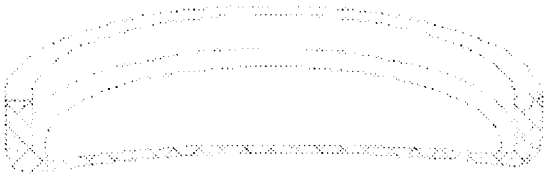
FIG. 8 is a sectional view of a concave inner cover in the present invention.

A first LED bulb:

an integral LED bulb for implementing the foregoing method, including a heat conductive bracket 3 provided with a cooling fin, wherein a silver paste printed circuit 4 is embedded on the heat conductive bracket 3, and an LED chip and a related drive chip are welded on the silver paste printed circuit 4, and a waterproof joint 10A with a cable is fixed to the heat conductive bracket 31 through a cable fixing head 11A, as shown in FIG. 5. A slot 18 is provided to the heat conductive bracket 3, a bulb inner cover 6 is embedded and fixed in the slot 18, and the bulb inner cover 6 covers the LED chip and the drive chip, as shown in FIG. 6. The edge of the heat conductive bracket 3 is of an installation flange structure and is fixed by a bulb fixing screw 105, the slot 18 is further provided outside the bulb inner cover 6, and a bulb outer cover 9 or a lens snap ring 8 and a lens 7 are further embedded in the slot 18. The slot 18 is provided to the heat conductive bracket 3, the bulb outer cover 9 is directly embedded in the slot by adhesion, as shown in FIG. 4, or the lens snap ring 8 clamps the lens 7 and the lens snap ring 8 is embedded in the slot by adhesion, as shown in FIG. 3. Transparent silica gel for package is provided outside the LED chip, the bulb inner cover 6 is provided only outside the LED chip with the transparent silica gel, and fluorescent powder coating is provided to the inner layer of the bulb inner cover 6; or, the LED chip is packaged with no silica gel, a concave inner cover 61 filled with transparent insulating heat conductive liquid is provided outside the LED chip, as shown in FIG. 7, the LED chip is soaked in the transparent insulating heat conductive liquid, the fluorescent material is provided in the transparent insulating heat conductive liquid, and the concave inner cover 61 is an elastic inner cover of a thin concave structure, as shown in FIG. 8. The LED chip may also be packaged by adopting a traditional package solution, namely, fluorescent powder is spray coated on the LED chip and transparent silica gel is covered thereon, and no bulb inner cover is used. When the present invention is applied to agricultural production lighting, the number of the LED chips is configured according to the proportion of blue and red lights necessary for plants, and only the transparent silica gel is covered on the welded LED chip for package.

Figure 9:
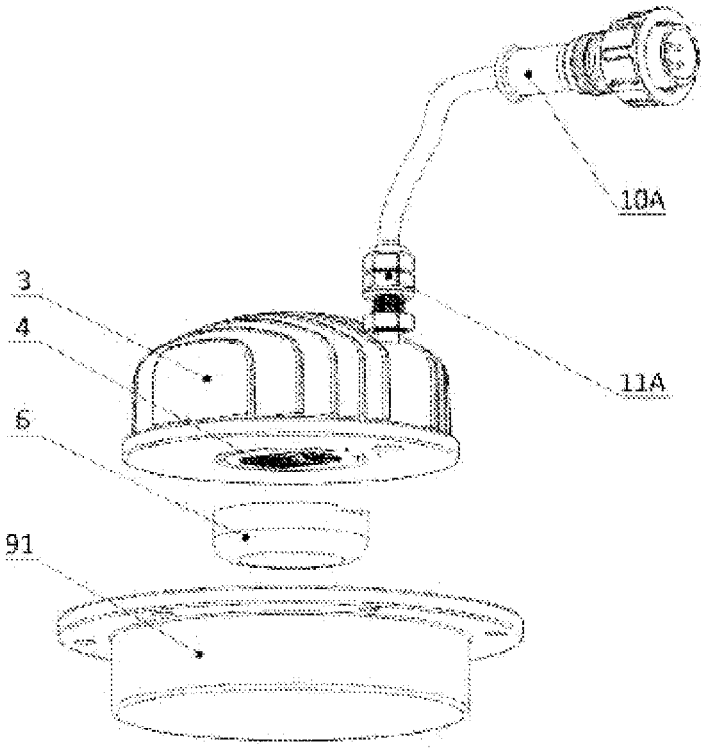
FIG. 9 is a schematic diagram of a structure of a second LED bulb in the present invention.

A second LED bulb:

an integral LED bulb for implementing the foregoing method, including a heat conductive bracket 3 provided with a cooling fin, wherein a silver paste printed circuit 4 is embedded on the heat conductive bracket 3, and an LED chip is welded on the silver paste printed circuit 4, or a drive chip is further welded thereon, and a waterproof joint 10A with a cable is fixed to a connector fixing hole 22 of the heat conductive bracket 3 through a cable fixing head 11A, as shown in FIG. 5. A slot 18 is provided to the heat conductive bracket 3, a bulb inner cover 6 is fixed to the slot in an embedding manner, and the bulb inner cover 6 covers the LED chip and the drive chip, as shown in FIG. 6. The heat conductive bracket 3 is fixed in the bulb outer cover 91 with an installation flange, as shown in FIG. 9. Only transparent silica gel for package is provided outside the LED chip, the bulb inner cover 6 is provided outside the LED chip with the transparent silica gel, and fluorescent powder coating is provided to the inner layer of the bulb inner cover 6; or, the LED chip is packaged with no silica gel, and a concave inner cover 61 filled with transparent insulating heat conductive liquid is provided outside the LED chip, as shown in FIG. 7.

The LED chip is soaked in the transparent insulating heat conductive liquid, a fluorescent material is provided in the transparent insulating heat conductive liquid, and the concave inner cover 61 is an elastic inner cover of a thin concave structure, as shown in FIG. 8. The LED chip may also be packaged by adopting a traditional package solution, namely, fluorescent powder is spray coated on the LED chip and transparent silica gel is covered thereon, and no bulb inner cover is used. When the present invention is applied to agricultural production lighting, the number of the LED chips is configured according to the proportion of blue and red lights necessary for plants, and only the transparent silica gel is covered on the welded LED chip for package.

Figure 10:
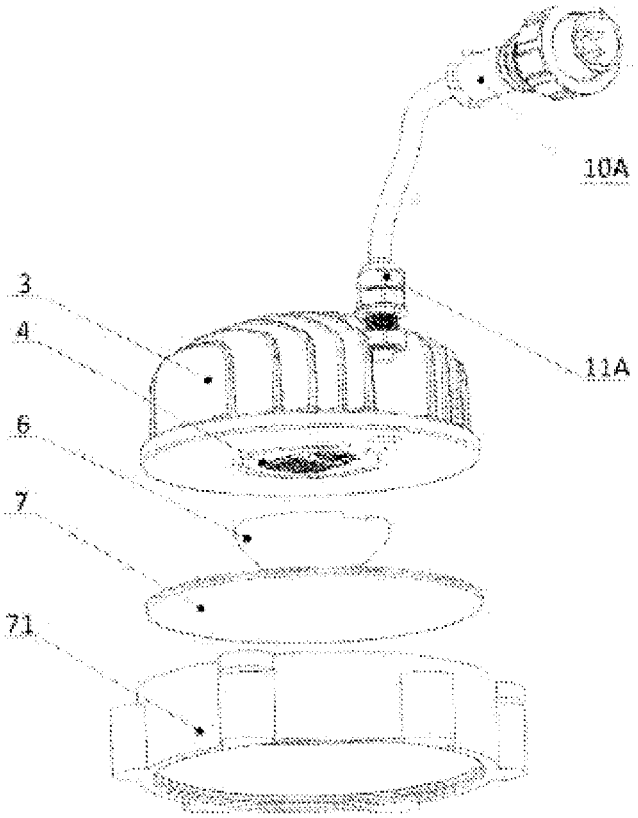
FIG. 10 is a schematic diagram of a structure of a third LED bulb in the present invention.
Figure 11:
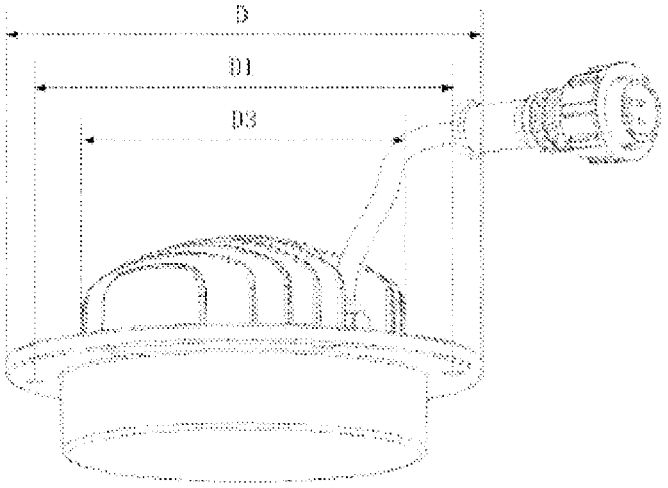
FIG. 11 is a schematic diagram of an outline of the second LED bulb in the present invention.
Figure 12:
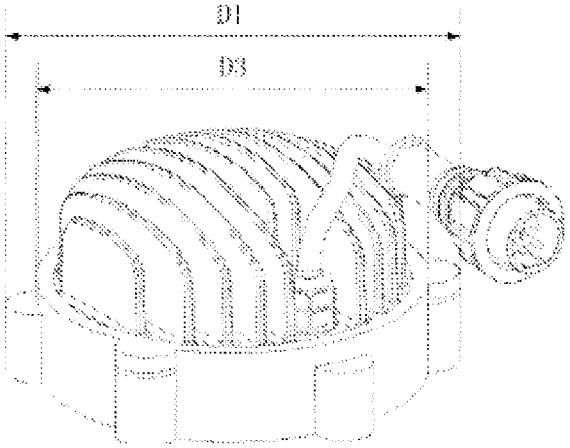
FIG. 12 is a schematic diagram of an outline of the third LED bulb in the present invention.

A third LED bulb: an integral LED bulb for implementing the foregoing method, including a heat conductive bracket 3 provided with a cooling fin, wherein a silver paste printed circuit 4 is embedded on the heat conductive bracket 3, and an LED chip is welded on the silver paste printed circuit 4, or a drive chip is further welded thereon, and a waterproof joint 10A with a cable is fixed to a connector fixing hole of the heat conductive bracket 3 through a cable fixing head 11A, as shown in FIG. 5. A slot 18 is provided to the heat conductive bracket 3, a bulb inner cover 6 is fixed to the slot in an embedding manner, and the bulb inner cover 6 covers the LED chip and the drive chip, as shown in FIG. 6. The heat conductive bracket 3 is fixed in a lens bracket 71 with a hang lug, and a lens 7 is provided at the lower end of the lens bracket 71, as shown in FIG. 10. Transparent silica gel for package is provided outside the LED chip, the bulb inner cover 6 is provided outside the LED chip with the transparent silica gel, and fluorescent powder coating is provided to the inner layer of the bulb inner cover 6; or, no silica gel is packaged on the LED chip, and a concave inner cover 61 filled with transparent insulating heat conductive liquid is provided outside the LED chip, as shown in FIG. 7. The LED chip is soaked in the transparent insulating heat conductive liquid, a fluorescent material is provided in the transparent insulating heat conductive liquid, and the concave inner cover 61 is an elastic inner cover of a thin concave structure, as shown in FIG. 8. The LED chip may also be packaged by adopting a traditional package solution, namely, fluorescent powder is spray coated on the LED chip and transparent silica gel is covered thereon, and no bulb inner cover is used. When the present invention is applied to agricultural production lighting, the number of the LED chips is configured according to the proportion of blue and red lights necessary for plants, and only the transparent silica gel is covered on the welded LED chip for package.

Figure 13:
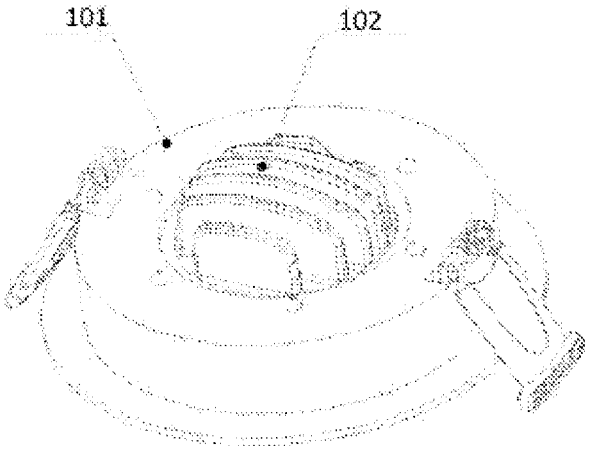
FIG. 13 is a schematic diagram of construction of a down lamp in the present invention.
Figure 14:
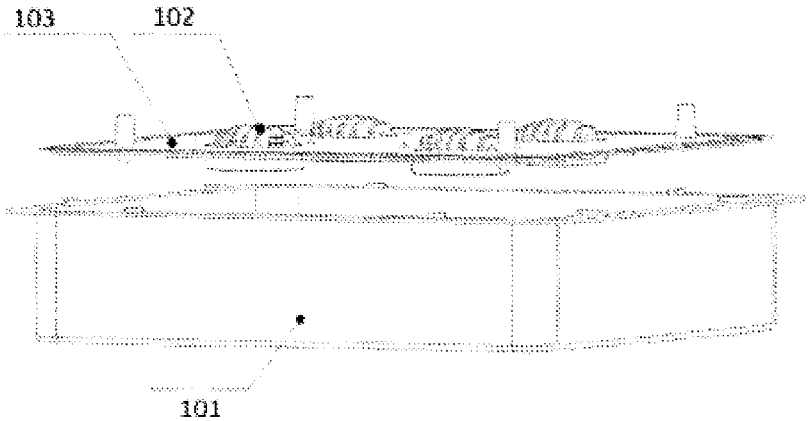
FIG. 14 is a schematic diagram of construction of a ceiling lamp in the present invention.

A lamp may be constructed just by fixing the integral LED bulb in the present invention on the lamp used as an installation interface. As shown in FIG. 13 and FIG. 14, a down lamp may be constructed by installing the integral LED bulb on a down lamp housing 101 with the installation interface; a ceiling lamp may be constructed by installing the integral LED bulb in a ceiling lamp head plate 103 with the installation interface and covering with a ceiling lamp housing 101.

The bulb outer diameter D and an upper limit of power W of the constructed LED bulb satisfy a relationship $W=1.1812e^{0.0361D}$, discrete numerical values are selected for D on the relationship curve $W=1.1812e^{0.0361D}$ to construct a plurality of LED bulbs with fixed bulb outer diameters D, in order to improve the interchangeability and universality of the LED bulbs. On the relationship curve $W=1.1812e^{0.0361D}$, with 20 mm used as the lower limit of D and 130 mm used as the upper limit, the relationship curve is divided into 12 segments each of which is set to 10 mm to form limited bulb outer diameter specifications, and the interchangeability and universality of the LED bulbs are further improved by the small amount of bulb outer diameter specifications. A screw hole distribution circle (or the outer diameter of the hang lug) D1 for fixing the bulb and the diameter D2 of an installation interface opening of the lamp are influenced by the size of the used screw, and the diameter D1 is a value obtained by subtracting a diameter of a fixing screw cap and then subtracting a margin of 0.8-4 mm from the outer diameter D of the LED bulb; the diameter D2 of the installation interface opening is a value obtained by subtracting two times of a diameter of a fixing screw cap and then subtracting two times of the margin corresponding to the diameter D1 from the outer diameter D of the bulb; the value of the wire outlet hole distance L of the bulb is set according to the following table. In FIG. 1, FIG. 2, FIG. 11 and FIG. 12, the outer diameter D of the size of the bulb, the diameter D1 of the flange screw hole (or the outer diameter of the hang lug) distribution circle and the outer diameter D3 of the cooling fin are manufactured according to specified sizes, and the related sizes are set forth in FIG. 15 and the following table:

| outer diameter D (mm) of bulb | Diameter D1 (mm) of screw hole distribution circle | Diameter D2 (mm) of instalation interface opening | Wire outlet hole distance L (mm) | Fixing screw specification ¢ (mm) | Suitable power (W) |
|---|---|---|---|---|---|
| 20 | 16 | 12 | 2 | M1.6 | <2.5 |
| 30 | 25 | 20 | 2 | M1.6 | <3.5 |
| 40 | 35 | 30 | 2 | M1.6 | <5 |
| 50 | 42 | 34 | 2 | M2.5 | <7 |
| 60 | 52 | 44 | 2 | M2.5 | <10 |
| 70 | 62 | 54 | 2 | M2.5 | <14.5 |
| 80 | 70 | 60 | 18 | M3.5 | <21 |
| 90 | 80 | 70 | 18 | M3.5 | <30 |
| 100 | 90 | 80 | 27 | M3.5 | <44 |
| 110 | 100 | 90 | 27 | M3.5 | <64 |
| 120 | 110 | 100 | 33 | M3.5 | <90 |
| 130 | 120 | 110 | 33 | M3.5 | <130 |

Note 1:
the outer diameter D3 of the bulb radiator or the outer cover is not larger than D2-1;
note 2:
the diameter Φ of the bulb wire outlet hole is determined according to the size of the bulb connector (interface) plug.

Embodiment 1

Figure 15:
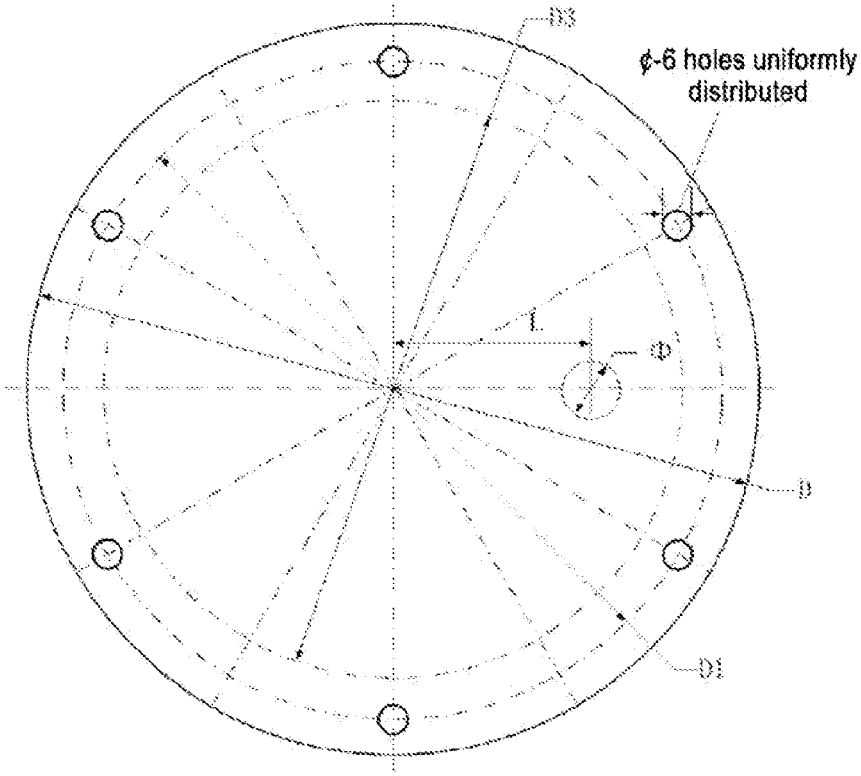
FIG. 15 is a schematic diagram of a size of a bulb in an embodiment of the present invention.
Figure 16:
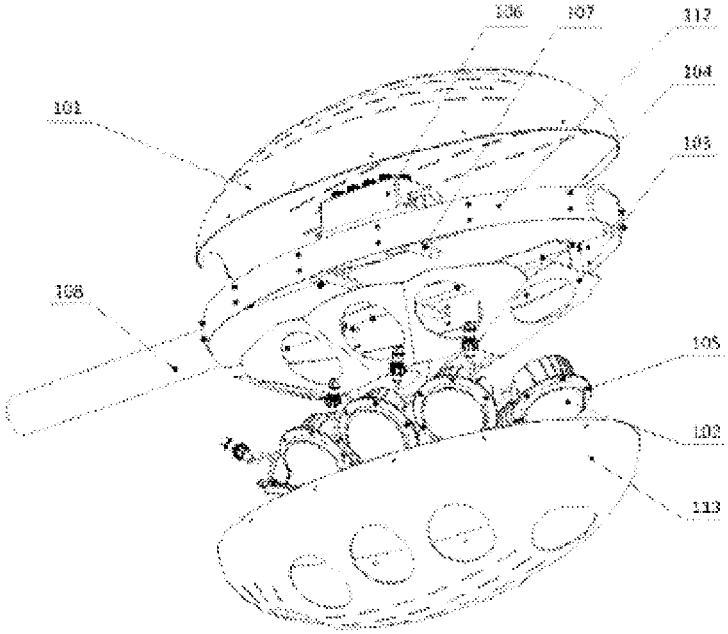
FIG. 16 is a schematic diagram of a structure of embodiment 1 in the present invention.
Figure 17:
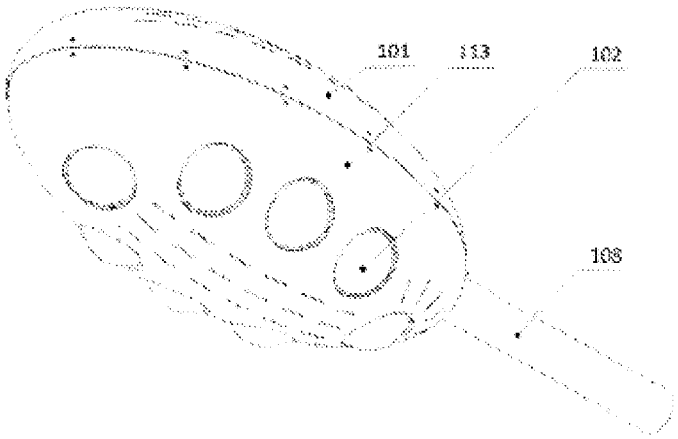
FIG. 17 is an external view of embodiment 1 of the present invention.
Figure 18:
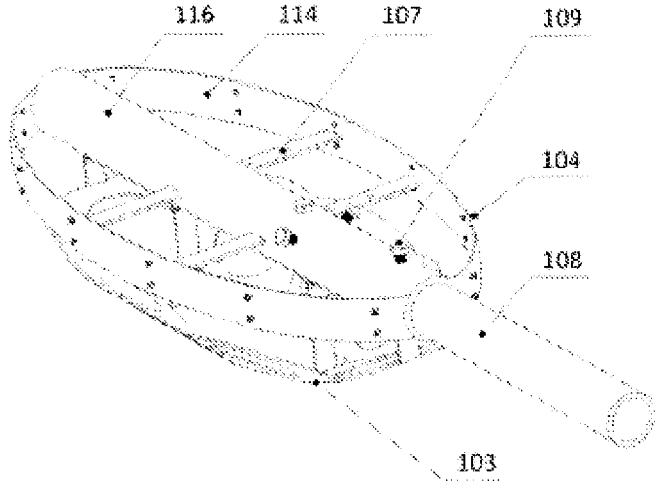
FIG. 18 is a structure diagram of an installation interface plate fixing bracket in embodiment 1 of the present invention.
Figure 19:
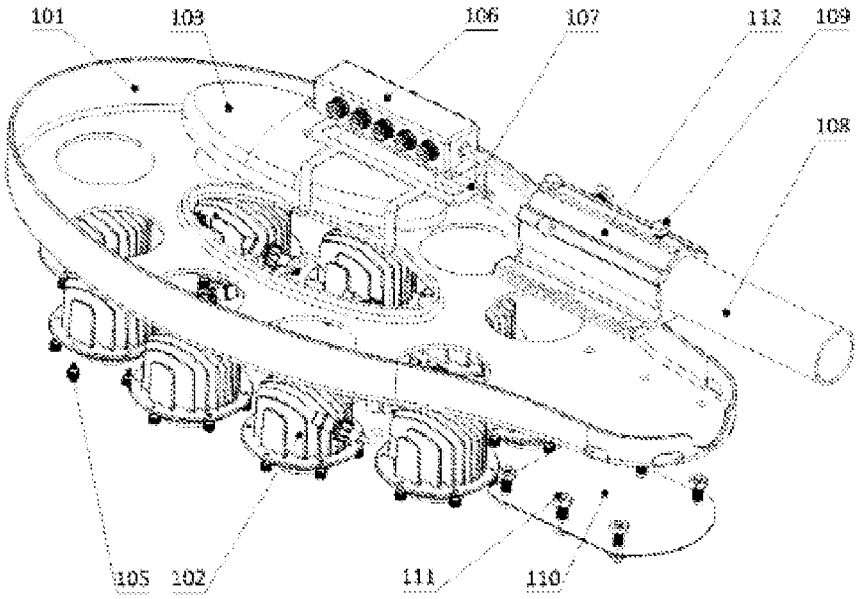
FIG. 19 is a schematic diagram of a structure of embodiment 2 in the present invention.
Figure 20:
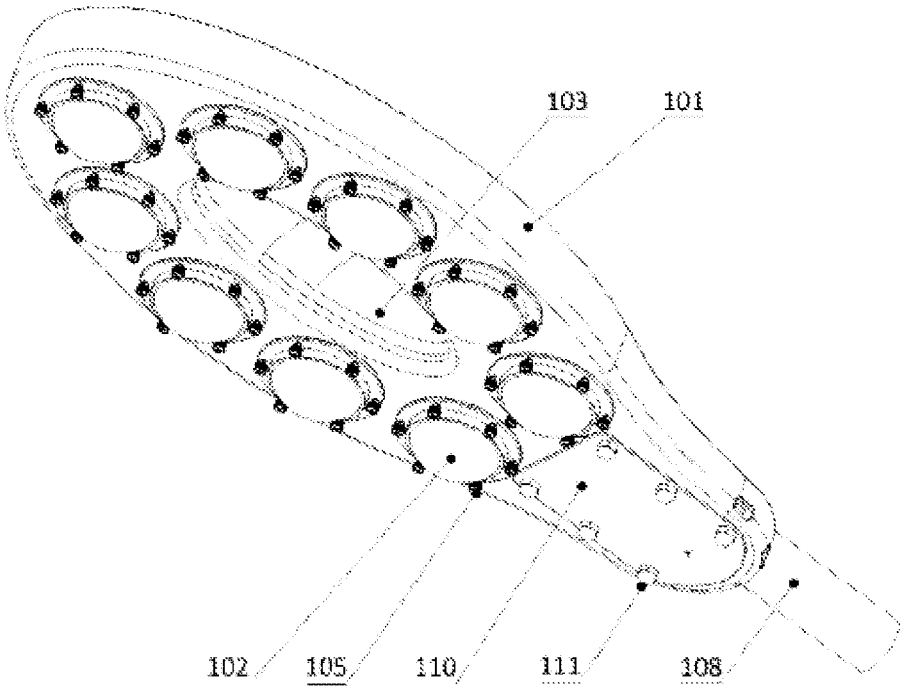
FIG. 20 is a vertical external view of embodiment 2 in the present invention.
Figure 21:
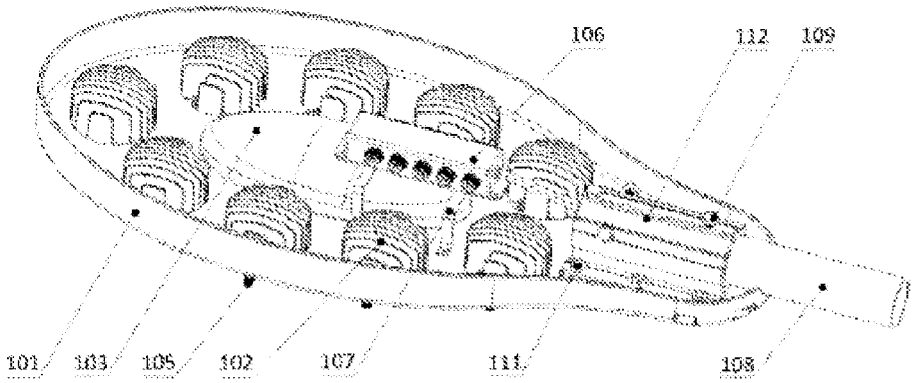
FIG. 21 is an overlooking external view of embodiment 2 in the present invention.
Figure 22:
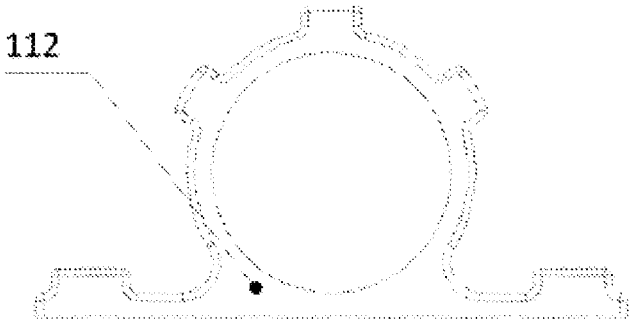
FIG. 22 is a projection drawing of a lamp post fixing bracket in embodiment 2 of the present invention.

An oval LED street lamp using an installation interface bracket structure, as shown in FIG. 1 and FIG. 14, including an installation interface plate fixing bracket 112, wherein an installation interface plate 103 is provided at the lower part of the installation interface plate fixing bracket 112, an installation interface is provided to the installation interface plate 103, and an LED bulb 102 is provided to the installation interface; the installation interface plate fixing bracket 112 is connected to a lamp post 108; a lamp housing 101 is provided at the upper part of the installation interface plate fixing bracket 112, a lampshade 113 is provided outside the installation interface plate 103, and the lamp housing 101 matches with the lampshade 113 to form an oval shape. A wire harness connector 106 is provided to the installation interface plate fixing bracket 112, and the wire harness connector 106 is used for connecting a plurality of LED bulbs 102 to a power supply and a control circuit. The installation interface plate fixing bracket 112 includes a sleeve 116, the sleeve 116 is used for installing the lamp post 108, wire harness connector brackets 107 are provided on both sides of the sleeve 116, and the wire harness connector brackets 107 are used for installing the wire harness connector 106; a ring plate 114 is provided outside the sleeve 116 and the wire harness connector brackets 107, and the ring plate 114 is used for fixedly connecting the installation interface plate 103 to the installation interface plate fixing bracket 112, as shown in FIG. 15. A light penetration hole is provided to the lampshade 113; the installation interface includes a surface in contact with the LED bulb 102 and a hole connected to the LED bulb on the installation interface plate 103. A radiator interface opening and 6 flange fixing holes are provided to the installation interface of the installation interface plate 103, the flange fixing holes are used for fixing the LED bulb 102, and the radiator interface opening is used for enabling the LED bulb 102 to penetrate through the installation interface; the flange fixing holes are uniformly distributed at a diameter D1, and the diameter D1 is a value obtained by subtracting a diameter of a fixing screw cap and then subtracting a margin of 0.8-4 mm from the outer diameter D of the LED bulb 102; the diameter D2 of the radiator interface opening on the installation interface is a value obtained by subtracting two times of a diameter of a fixing screw cap and then subtracting two times of the margin corresponding to the diameter D1 from the outer diameter D of the bulb. The LED bulb 102 is installed on the bulb installation interface through a bulb fixing screw 105, and the lamp post 108 is installed in the sleeve through a lamp post fixing screw 109.

The lamp in the embodiment uses the installation interface plate fixing bracket as the core, the installation interface plate fixing bracket provides an installation interface for the lamp post while providing a supporting interface for the installation interface plate, and the installation interface plate provides an installation interface for the LED bulb. In the present invention, the LED bulb and all of other auxiliary components are collectively installed and fixed to the installation interface plate fixing bracket, thus the LED street lamp is simple, practical and beautiful.

The meanings of the reference numerals in the embodiment are as follows: 101—lamp housing, 102—LED bulb, 103—installation interface plate, 105—bulb fixing screw, 106—wire harness connector, 107—wire harness connector bracket, 108—lamp post, 109—lamp post fixing screw, 112—installation interface plate fixing bracket, 113—lampshade, 114—ring plate, and 116—sleeve.

Embodiment 2

An LED street lamp using a lamp housing as an installation interface bracket structure, as shown in FIG. 19, FIG. 20, FIG. 21 and FIG. 22, includes the lamp housing 101 punch formed by sheet metal via a stamping process, wherein an installation interface is provided to the lamp housing 101, an LED bulb 102 is provided to the installation interface, the lamp housing 101 is fixed to a lamp post 108 by a lamp post fixing element, and a decorative cover 103 is provided to the lamp housing 101. The LED street lamp using the lamp housing as the installation interface bracket structure further includes a wire harness connector 106, wherein the wire harness connector 106 is provided to the decorative cover 103, and the wire harness connector 106 is used for connecting a plurality of LED bulbs 102 to a power supply and a control circuit. The lamp housing 101 is elliptic, edgefolds for reinforcing the structural strength are provided at the inner and outer edges of the lamp housing 101, and the installation interface includes a surface in contact with the LED bulb 102 and a hole connected to the LED bulb, on the lamp housing 101. The lamp post fixing element includes a lamp post fixing bracket 112, a lamp post fixing bracket bolt 111 and a reinforcing plate 110, wherein the lamp post fixing bracket 112 and the reinforcing plate 110 are provided at the upper and lower sides of the lamp housing 101, and the lamp housing 101 is fixed to the lamp post 108 through the lamp post fixing bracket 112 and the reinforcing plate 110. A radiator interface opening and 6 flange fixing holes are provided to the installation interface of the lamp housing 101, the flange fixing holes are used for fixing the LED bulb 102, and the radiator interface opening is used for enabling the LED bulbs 102 to penetrate through the installation interface; the flange fixing holes are uniformly distributed at a diameter D1, and the diameter D1 is a value obtained by subtracting a diameter of a fixing screw cap and then subtracting a margin of 0.8-4 mm from the outer diameter D of the LED bulb 102; the diameter D2 of the radiator interface opening on the installation interface is a value obtained by subtracting two times of a diameter of a fixing screw cap and then subtracting two times of the margin corresponding to the diameter D1 from the outer diameter D of the bulb. The wire harness connector 106 is fixed to the decorative cover 103 through a wire harness connector bracket and screw 107. The lamp post fixing bracket 112 is fixed to the lamp housing 101 through the reinforcing plate 110 and the lamp post fixing bracket bolt 111, and the lamp post 108 is connected to the lamp post fixing bracket 112 through a lamp post fixing screw 109. Each LED bulb 102 is installed on the lamp housing 101 through bulb fixing screws 105, and the LED bulb 102 penetrates through an installation interface hole. The LED bulb 102 is installed on the installation interface from the lower side.

In the embodiment, a heat conductive pad 2 is provided between a flange or an installation flange and the installation interface.

In the embodiment, the heat conductive bracket 3 may also be fixed in a bulb outer cover 91 provided with the installation flange.

Figure 23:
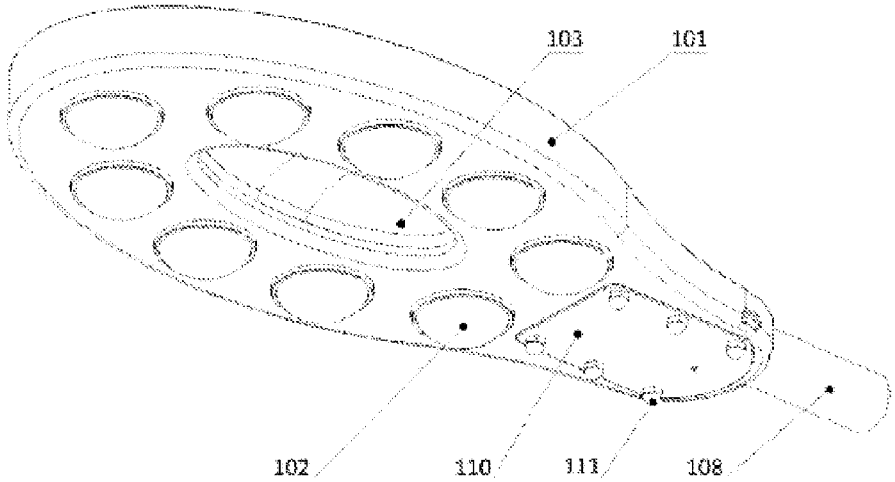
FIG. 23 is a vertical external view of embodiment 2 in the present invention.
Figure 24:
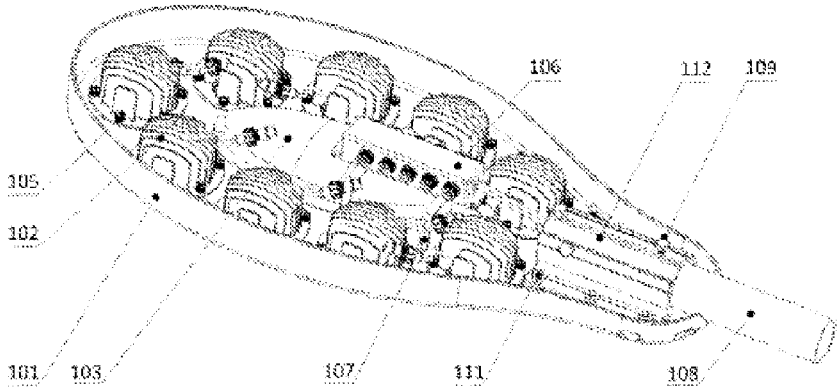
FIG. 24 is an overlooking external view of embodiment 2 in the present invention.

In the embodiment, the LED bulb 102 may also be installed on the lamp housing from the upper side, as shown in FIG. 23 and FIG. 24.

The meanings of the reference numerals in the embodiment are as follows: 101-lamp housing, 102-LED bulb, 103-decorative cover, 105-bulb fixing screw, 106-wire harness connector, 107-wire harness connector bracket and screw, 108-lamp post, 109-lamp post fixing screw, 110-reinforcing plate, 111-lamp post fixing bracket bolt, and 112-lamp post fixing bracket.

Embodiment 3

Figure 25:
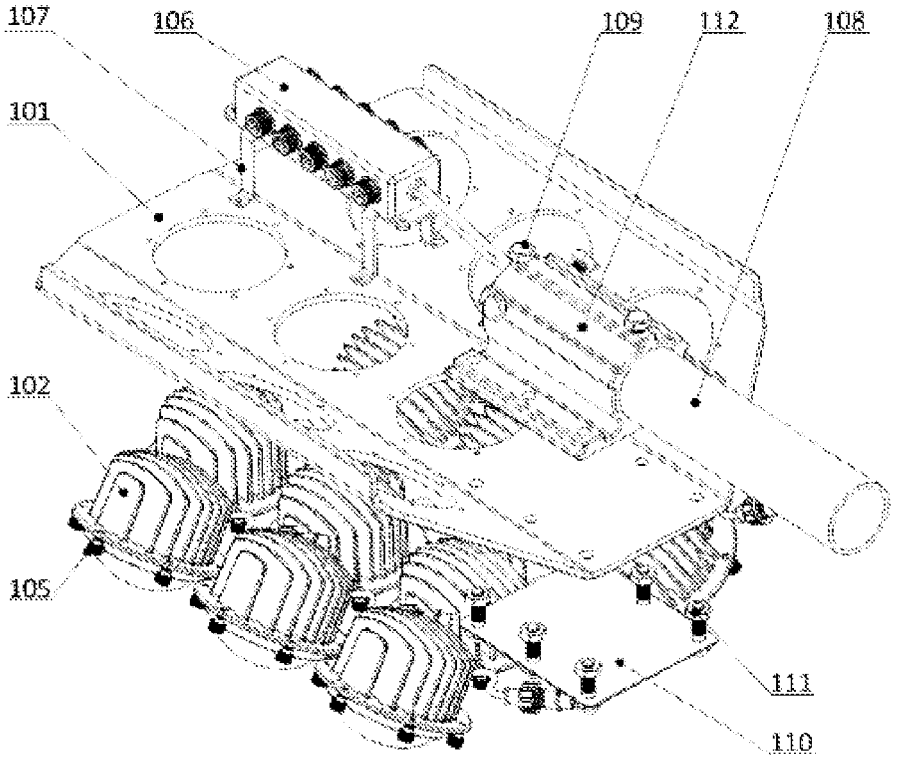
FIG. 25 is a schematic diagram of a structure of embodiment 3 in the present invention.
Figure 26:
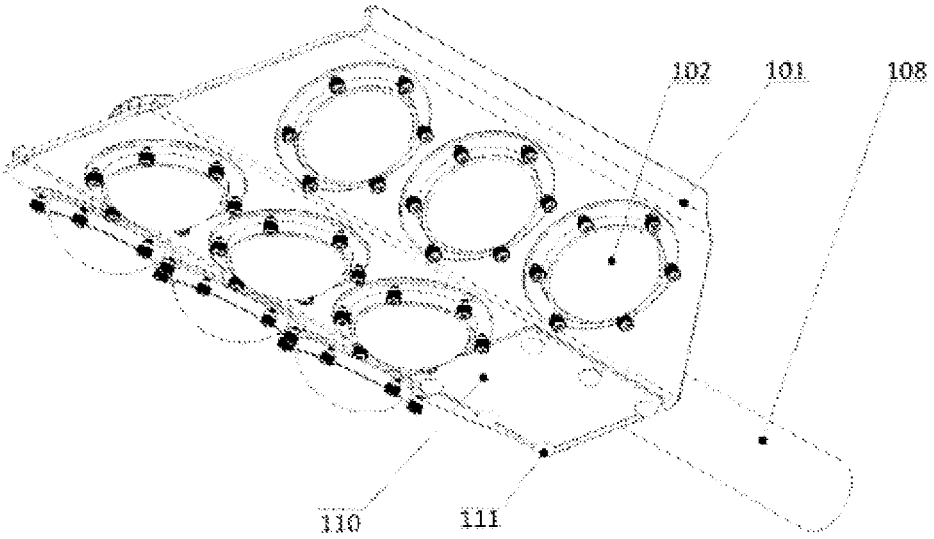
FIG. 26 is a vertical external view of embodiment 3 in the present invention.
Figure 27:
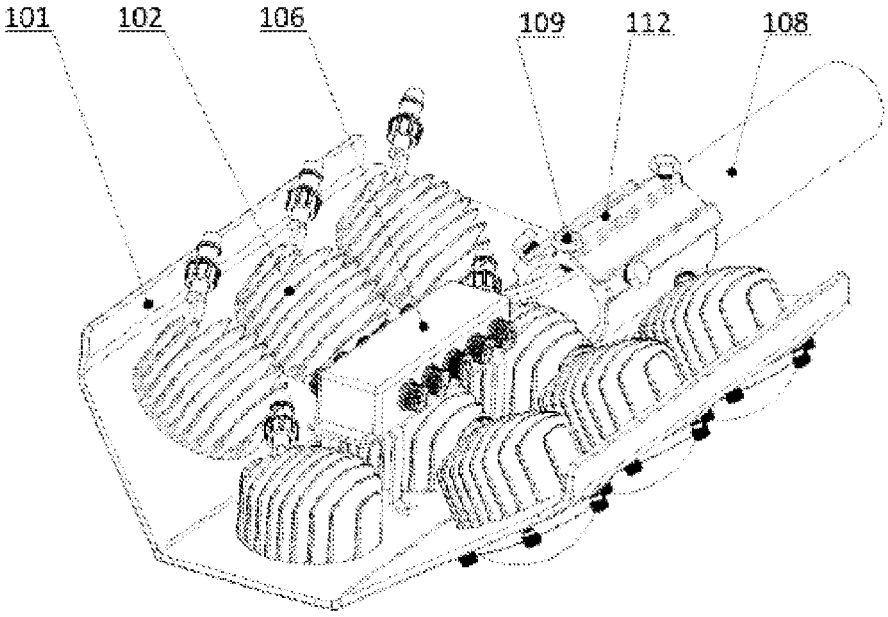
FIG. 27 is an overlooking external view of embodiment 3 in the present invention.

An LED street lamp using a lamp housing as an installation interface bracket structure, as shown in FIG. 25, FIG. 26 and FIG. 27, includes a lamp housing 101 punch formed by sheet metal; the lamp housing 101 includes a bracket panel folded to multiple pieces, an installation interface is provided to the bracket panel, and an LED bulb 102 is provided to the installation interface; the lamp housing 101 is fixed to a lamp post 108 through a lamp post fixing element. The LED street lamp using the lamp housing as the installation interface bracket structure further includes a wire harness connector 106, wherein the wire harness connector 106 is provided to the lamp housing 101, and the wire harness connector is used for connecting a plurality of LED bulbs 102 to a power supply and a control circuit. An edgefold for reinforcing the structural strength is provided at the edge of the lamp housing 101, and the installation interface includes a surface in contact with the LED bulb 102 and a hole connected to the LED, bulb on the lamp housing 101; a lamp post fixing hole used for connecting the lamp post 108 is formed in the upper part of the lamp post fixing bracket 112. The lamp post fixing element includes a lamp post fixing bracket 112, a lamp post fixing bracket bolt 111 and a reinforcing plate 110, wherein the lamp post fixing bracket 112 and the reinforcing plate 110 are provided at the upper and lower sides of the lamp housing 101, and the lamp housing 101 is fixed to the lamp post 108 through the lamp post fixing bracket 112 and the reinforcing plate 110; the lamp housing 101 includes three bracket panels which are folded to form an angle, a planar bracket is provided at the lower part of the lamp post fixing bracket 112, and the lamp post fixing bracket 112 is fixed to the bracket panel at the center of the lamp housing 101 from the upper side or the lower side of the lamp housing 101. 6 flange fixing holes and a radiator interface opening are provided to the installation interface, the flange fixing holes are used for fixing each LED bulb 102, and the radiator interface opening is used for enabling the LED bulb 102 to penetrate through the installation interface; the 6 flange fixing holes are uniformly distributed at a diameter D1, and the diameter D1 is a value obtained by subtracting a diameter of a fixing screw cap and then subtracting a margin of 0.8-4 mm from the outer diameter D of the LED bulb 102; the diameter D2 of the radiator interface opening is a value obtained by subtracting two times of a diameter of a fixing screw cap and then subtracting two times of the margin corresponding to the diameter D1 from the bulb outer diameter D. The LED bulb 102 is installed on the installation interface through a bulb fixing screw 105, the wire harness connector 106 is installed on the lamp housing 101 through a wire harness connector bracket and screw 107, the lamp post fixing bracket 112 and the reinforcing plate 110 are fixed to the lamp housing 101 through the lamp post fixing bracket bolt 111, and the lamp post 108 is connected to the lamp post fixing bracket 112 through a lamp post fixing screw 109.

Figure 28:
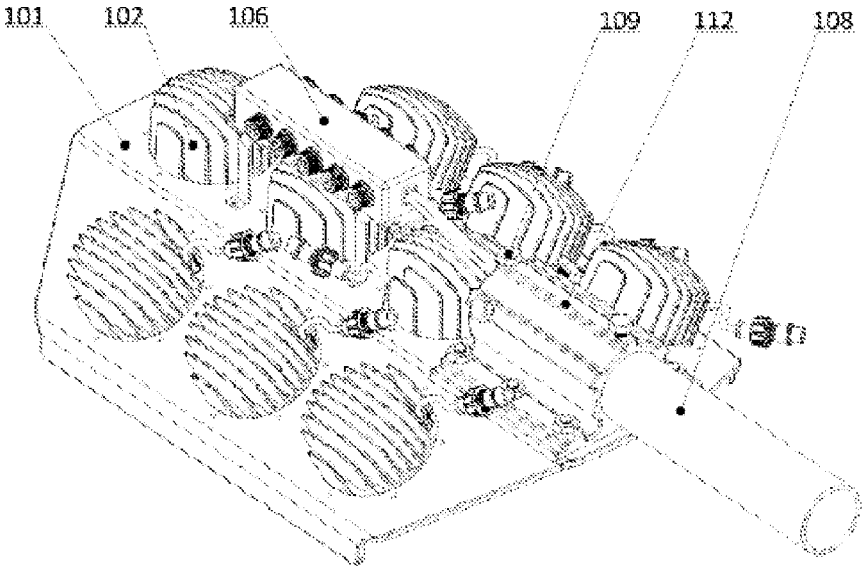
FIG. 28 is an overlooking external view when bracket panels on both sides are provided downwards to form an angle in embodiment 3 of the present invention.
Figure 32:
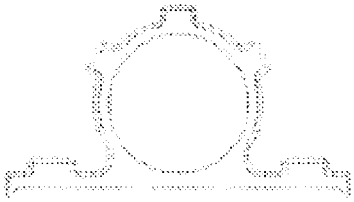
FIG. 32 is a projection drawing of a lamp post fixing bracket when bracket panels on both sides are provided downwards to form an angle in embodiment 3 of the present invention.

In the embodiment, the bracket panels on both sides may also be provided downwards to form an angle, as shown in FIG. 28 and FIG. 32.

Figure 29:
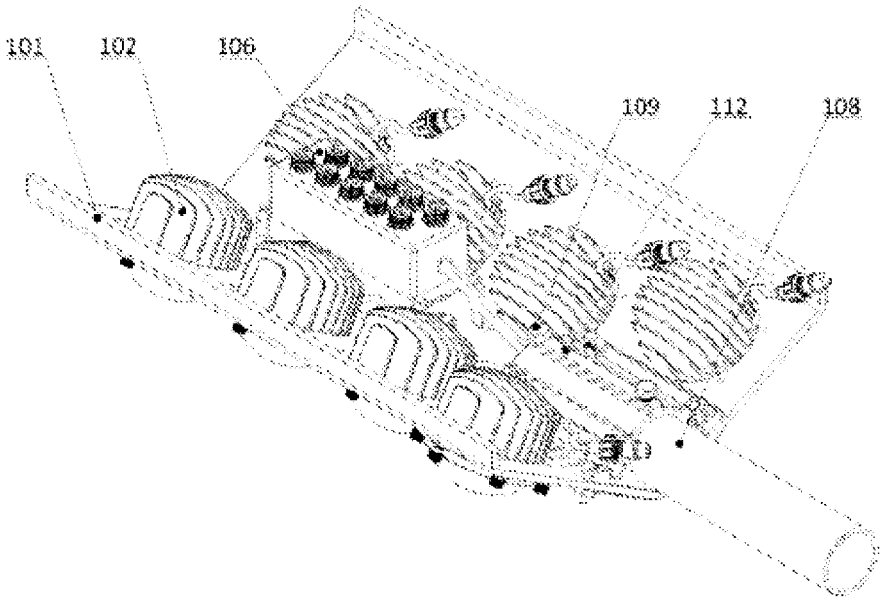
FIG. 29 is an overlooking external view when two bracket panels are adopted in embodiment 3 of the present invention.
Figure 33:
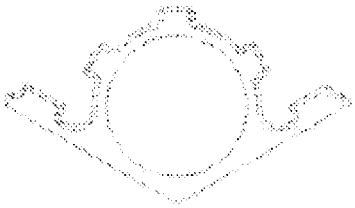
FIG. 33 is a projection drawing of a lamp post fixing bracket when two bracket panels are adopted in embodiment 3 of the present invention.

In the embodiment, or the lamp housing 101 includes two bracket panels which are folded upwards to form an angle, at this time, a triangular bracket is provided at the lower part of the lamp post fixing bracket 112 and is V-shaped, as shown in FIG. 29 and FIG. 33.

Figure 30:
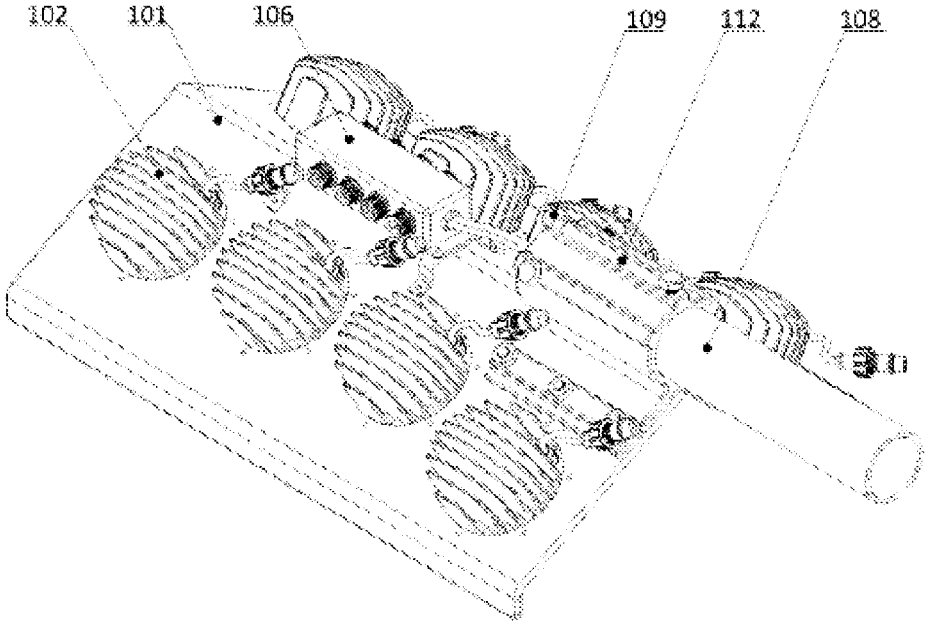
FIG. 30 is an overlooking external view when two bracket panels are provided downwards to form an angle in embodiment 3 of the present invention.
Figure 31:
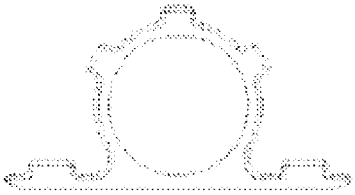
FIG. 31 is a projection drawing of a lamp post fixing bracket in embodiment 3 of the present invention.
Figure 34:
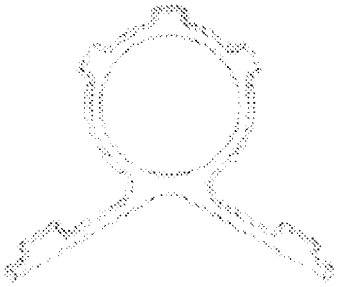
FIG. 34 is a projection drawing of a lamp post fixing bracket when two bracket panels are provided downwards to form an angle in embodiment 3 of the present invention.

In the embodiment, or the lamp housing 101 includes two bracket panels which are folded downwards to form an angle, at this time, a triangular bracket is provided at the lower part of the lamp post fixing bracket 112 and is inverted V-shaped, as shown in FIG. 30 and FIG. 34.

In the present invention, in the case of an accident, the bulb may be conveniently maintained and changed just by directly detaching the bulb 102 from the lamp housing 101, as shown in FIG. 25.

The meanings of reference numerals in the embodiment are as follows: 101—lamp housing, 102—LED bulb, 105—bulb fixing screw, 106—wire harness connector, 107—wire harness connector bracket and screw, 108-lamp post, 109—lamp post fixing screw, 110—reinforcing plate, 111—lamp post fixing bracket bolt, and 112—lamp post fixing bracket.

Embodiment 4

Figure 35:
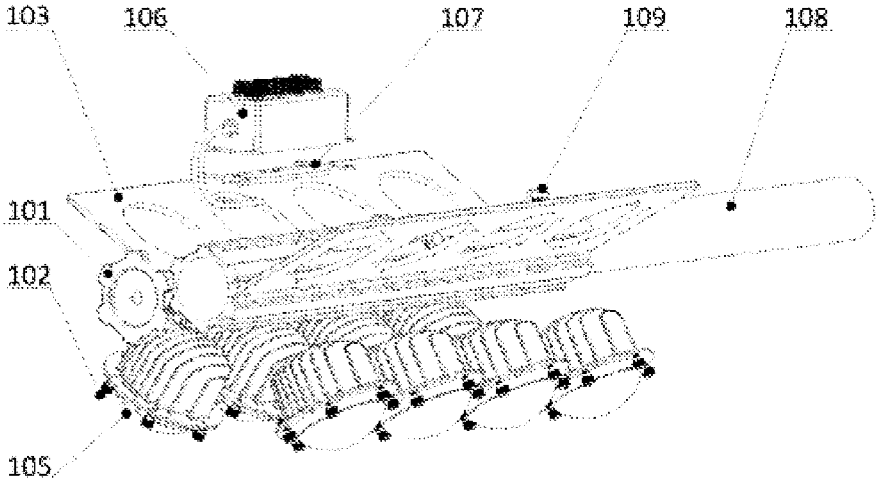
FIG. 35 is a schematic diagram of a structure of embodiment 4 in the present invention.
Figure 36:
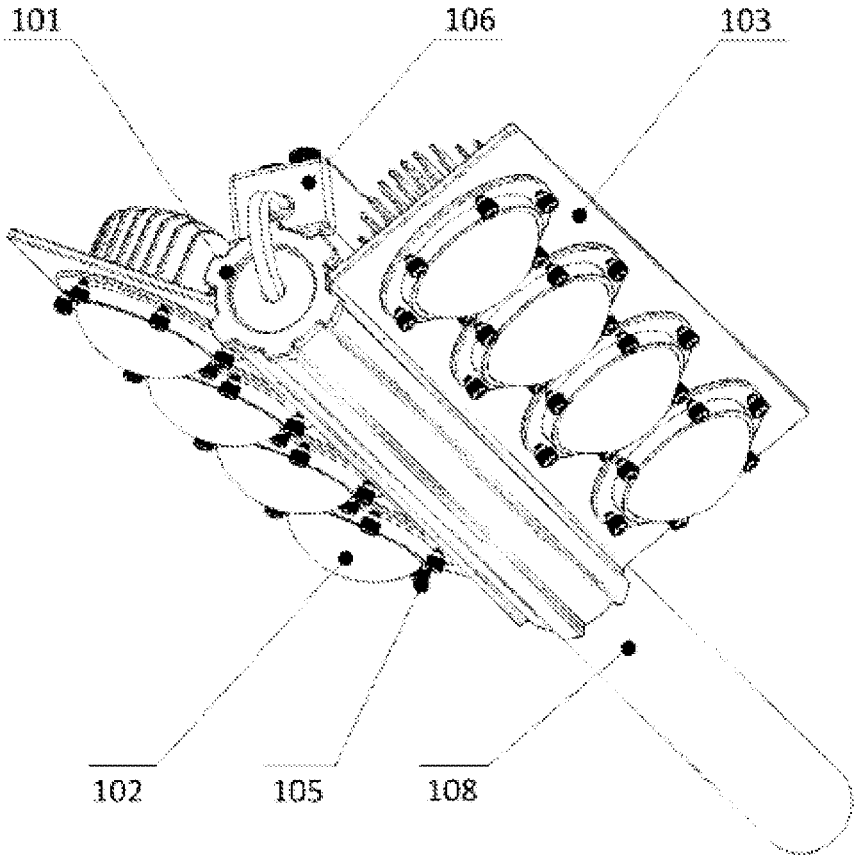
FIG. 36 is a vertical external view of embodiment 4 in the present invention.
Figure 40:
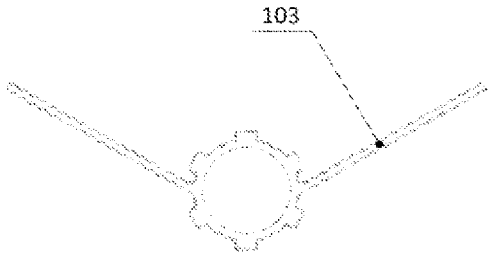
FIG. 40 is a projection drawing of a lamp post fixing bracket in embodiment 4 of the present invention.

An LED street lamp using an extrusion type installation interface bracket structure, as shown in FIG. 35 and FIG. 36, including an extrusion type installation interface bracket 103, wherein the extrusion type installation interface bracket 103 is fixed to a lamp post 108; the extrusion type installation interface bracket 103 includes a lamp post fixing sleeve, bracket panels are provided on both sides of the lamp post fixing sleeve, and an installation interface used for installing an LED bulb 102 is provided to each bracket panel; the LED bulb 102 with waterproof and dustproof functions and provided with a radiator is installed on the installation interface. The LED street lamp using the extrusion type installation interface bracket structure further includes a wire harness connector 106, wherein the wire harness connector 106 is provided to the lamp post fixing sleeve, and the wire harness connector 106 is used for connecting a plurality of LED bulbs 102 to a power supply and a control circuit. In the extrusion type installation interface bracket 103, the bracket panels on both sides are provided upwards to form an angle, as shown in FIG. 40; a lamp post seal head 101 is provided at one end of the lamp post fixing sleeve, and the other end of the lamp post fixing sleeve is fixed to the lamp post 108 through a lamp post fixing screw 109; the installation interface includes a surface in contact with the LED bulb 102 and a hole connected to the LED bulb, on the bracket panels. A radiator interface opening and 6 flange fixing holes are provided to the installation interface, the flange fixing holes are used for fixing the LED bulb 102, and the radiator interface opening is used for enabling the LED bulb 102 to penetrate through the installation interface; the 6 flange fixing holes are uniformly distributed at a diameter D1, and the diameter D1 is a value obtained by subtracting a diameter of a fixing screw cap and then subtracting a margin of 0.8-4 mm from the outer diameter D of the LED bulb 102; the diameter D2 of the radiator interface opening is a value obtained by subtracting two times of a diameter of a fixing screw cap and then subtracting two times of the margin corresponding to the diameter D1 from the bulb outer diameter D. The LED bulb 102 is installed on the installation interface through a bulb fixing screw 105. The wire harness connector 106 is installed on the lamp post fixing sleeve through a wire harness connector bracket and fixing screw 107.

Figure 37:
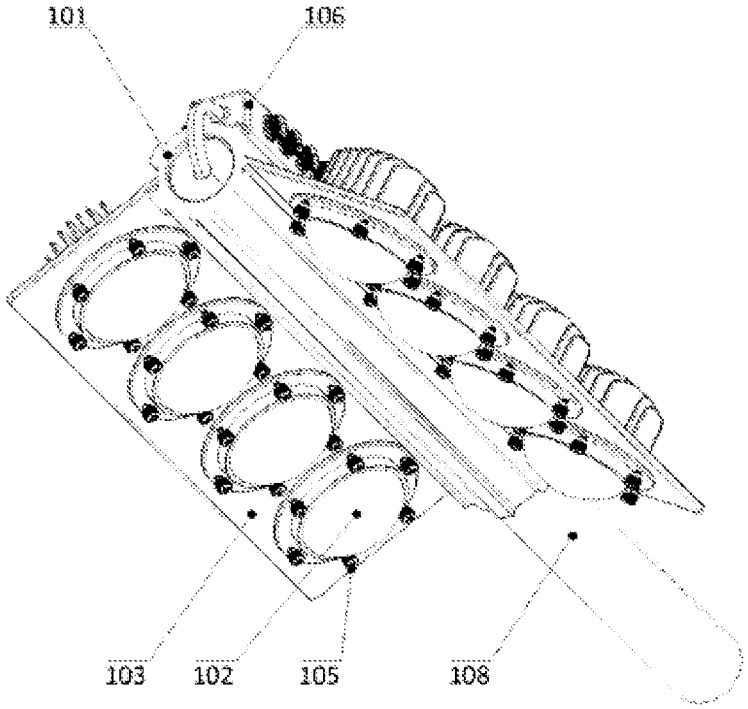
FIG. 37 is a vertical external view when bracket panels are provided downwards to form an angle in embodiment 4 of the present invention.
Figure 41:
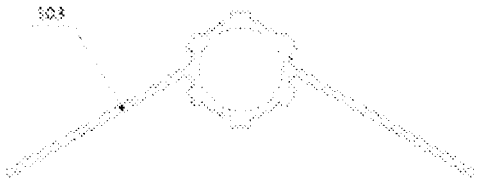
FIG. 41 is a projection drawing of a lamp post fixing bracket when bracket panels are provided downwards to form an angle in embodiment 4 of the present invention.

In the embodiment, the bracket panels may also be provided downwards to form an angle, as shown in FIG. 37 and FIG. 41.

Figure 38:
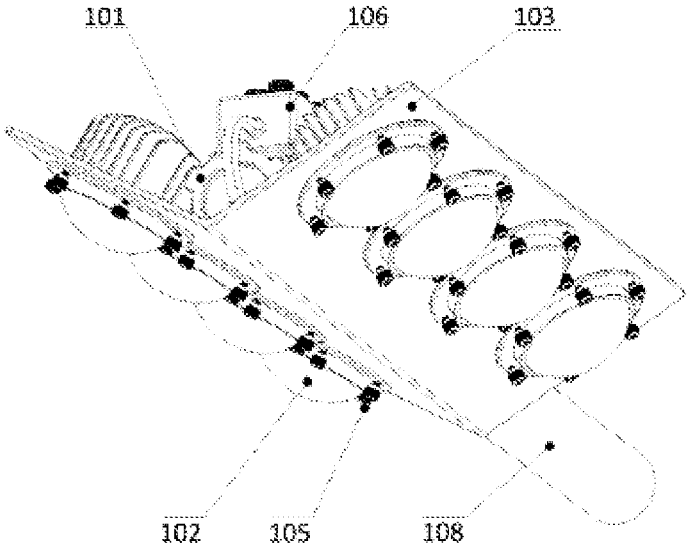
FIG. 38 is a vertical external view when bracket panels are connected and are provided upwards to form an angle in embodiment 4 of the present invention.
Figure 42:
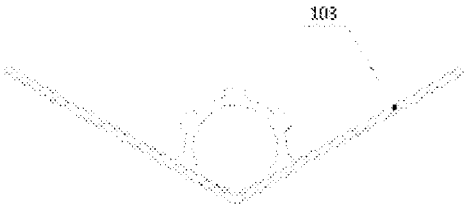
FIG. 42 is a projection drawing of a lamp post fixing bracket when bracket panels are connected and are provided upwards to form an angle in embodiment 4 of the present invention.

In the embodiment, the bracket panels may also be connected and provided upwards to form an angle, as shown in FIG. 38 and FIG. 42.

Figure 39:
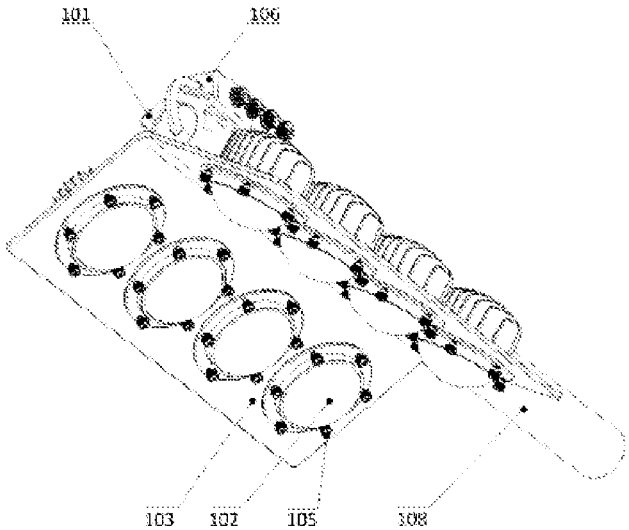
FIG. 39 is a vertical external view when bracket panels are connected and are provided downwards to form an angle in embodiment 4 of the present invention.
Figure 43:
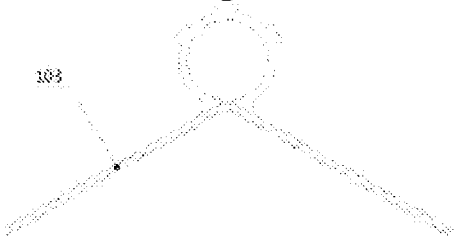
FIG. 43 is a projection drawing of a lamp post fixing bracket when bracket panels are connected and are provided downwards to form an angle in embodiment 4 of the present invention.
Figure 44:
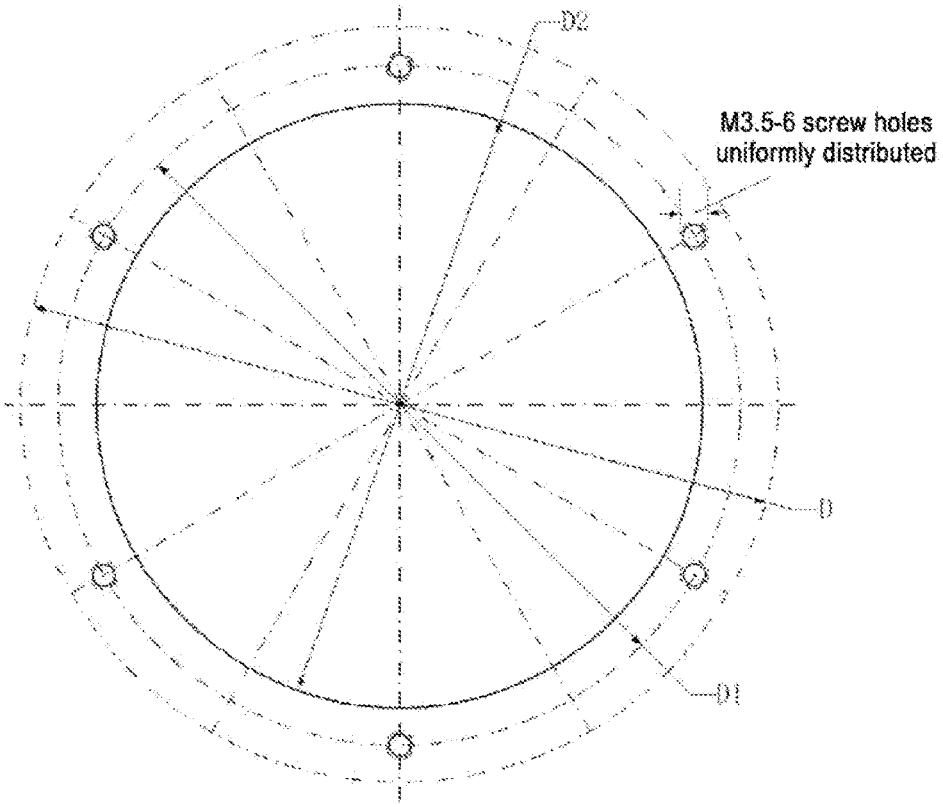
FIG. 44 is a schematic diagram of an installation interface on the lamp in an embodiment of the present invention.

In the embodiment, the bracket panels may also be connected and provided downwards to form an angle, as shown in FIG. 39 and FIG. 43.

In the present invention, in the case of an accident, the bulb may be conveniently maintained and changed just by directly detaching the bulb 102 from the extrusion type installation interface bracket 103, as shown in FIG. 35.

The lamp in the embodiment adopts the extrusion type installation interface bracket as the main component, the bracket panels of the extrusion type installation interface bracket provide installation supporting interfaces for the LED bulb, the LED bulb and other auxiliary components are overall collectively installed on the extrusion type installation interface bracket, thereby being simple in structure, low in manufacturing cost and convenient to install, use and maintain. The extrusion type installation interface bracket performs such functions of the lamp housing as preventing water and preventing dust and the like at the same time.

The meanings of the reference numerals in the embodiment are as follows: 101—lamp post seal head, 102—LED bulb, 103—extrusion type installation interface bracket, 105—bulb fixing screw, 106—wire harness connector, 107—wire harness connector bracket and fixing screw, 108—lamp post, and 109—lamp post fixing screw.

The invention claimed is:

1. A method for constructing an LED bulb with high interchangeability and universality, comprising:

embedding a silver paste printed circuit on a heat conductive bracket sintered by a nonmetal heat conductive material and provided with a cooling fin, and then welding an LED chip, or further welding a drive chip on the silver paste printed circuit to form the LED bulb, wherein a slot is provided to the heat conductive bracket, a bulb inner cover is embedded and fixed in the slot, and the bulb inner cover covers the LED chip or the drive chip;

wherein a second slot is further provided outside the bulb inner cover, a bulb outer cover or a lens snap ring and a lens are further embedded in the second slot.

2. The method for constructing the LED bulb with high interchangeability and universality of claim 1, wherein the bulb outer diameter D of the LED bulb and power W of the constructed LED bulb satisfy a relationship $W=1.1812e^{0.0361D}$, discrete numerical values are selected for D on the relationship curve $W=1.1812e^{0.0361D}$ to construct a plurality of LED bulbs with fixed bulb outer diameters D, in order to improve interchangeability and universality of the LED bulbs;

wherein on the relationship curve $W=1.1812e^{0.0361D}$, with 20 mm used as a lower limit of the bulb outer diameter D and 130 mm used as an upper limit, the relationship curve is divided into 12 segments each of which is set to 10 mm to form a limited number of bulb outer diameter specifications, and interchangeability and universality of the LED bulbs are further improved by the small amount of bulb outer diameter specifications; 6 flange fixing holes on the heat conductive bracket with the flange are uniformly distributed at a diameter D1, and the diameter D1 is a value obtained by subtracting a diameter of a fixing screw cap and then subtracting a margin of 0.8-4 mm from the outer diameter D of the bulb; the diameter D2 of an installation interface opening of the LED bulb on a lamp is a value obtained by subtracting two times of a diameter of a fixing screw cap and then subtracting two times of the margin corresponding to the diameter D1 from the outer diameter D of the bulb; the installation interface of the LED bulb includes a surface in contact with the LED bulb and a hole connected to the LED bulb on the lamp.

3. The method for constructing the LED bulb with high interchangeability and universality of claim 1, wherein the bulb inner cover is fixed to the heat conductive bracket by providing the slots, and the LED chip or the drive chip is wrapped in the bulb inner cover;

the bulb outer cover or the lens snap ring and the lens are further fixed to the heat conductive bracket by further providing a third slot, and a flange structure for installation is further sintered on the heat conductive bracket; or the heat conductive bracket is fixed in the bulb outer cover provided with an installation flange; or the heat conductive bracket is fixed in a lens bracket provided with a hang lug, and the lens is provided on a lower end of the lens bracket;

fluorescent powder is spray-coated on the LED chip, and transparent silica gel is covered thereon; or the number of the LED chips is configured according to a proportion of blue and red lights necessary for plants, and only transparent silica gel is covered on the welded LED chip for packaging.

4. An integral LED bulb, comprising a heat conductive bracket (3) provided with a cooling fin, wherein a silver paste printed circuit (4) is embedded on the heat conductive bracket (3), and an LED chip is welded on the silver paste printed circuit (4), or a drive chip is further welded thereon;

wherein a slot (18) is provided to the heat conductive bracket (3), a bulb inner cover (6) is embedded and fixed in the slot (18), and the bulb inner cover (6) covers the LED chip or the drive chip;

wherein an installation flange structure is provided at an edge of the heat conductive bracket (3), a second slot (18) is further provided outside the bulb inner cover (6), a bulb outer cover (9) or a lens snap ring (8) and a lens (7) are further embedded in the second slot (18); or the heat conductive bracket (3) is fixed in a bulb outer cover (91) provided with an installation flange; or the heat conductive bracket (3) is fixed in a lens bracket (71) provided with a hang lug, and the lens (7) is provided on a lower end of the lens bracket (71).

5. The integral LED bulb of claim 4, wherein fluorescent powder is spray-coated on the LED chip, and transparent silica gel is covered outside the fluorescent powder; or only transparent silica gel is covered on the LED chip; or only transparent silica gel for package is provided outside the LED chip, the bulb inner cover (6) is provided outside the LED chip with transparent silica gel and the drive chip, and fluorescent powder coating is provided to the inner layer of the bulb inner cover (6); or, no silica gel is packaged on the LED chip, a concave inner cover (61) filled with transparent insulating heat conductive liquid is provided outside the LED chip, the LED chip is soaked in the transparent insulating heat conductive liquid, the fluorescent material is provided in the transparent insulating heat conductive liquid, and the concave inner cover (61) is an elastic inner cover of a thin concave structure.

6. The integral LED bulb of claim 4, wherein the slots are provided to the heat conductive bracket (3), the bulb outer cover (9) is directly embedded in the second slot by adhesion, or the lens (7) is clamped by the lens snap ring (8) and the lens snap ring (8) is embedded in the second slot (18) by adhesion.

7. A lamp using the LED bulb of claim 4, comprising an installation interface, wherein the LED bulb is provided on the installation interface.

8. The of claim 7, wherein the lamp is an oval LED street lamp, the oval LED street lamp comprises an installation interface plate fixing bracket (112), an installation interface plate (103) is provided at the lower part of the installation interface plate fixing bracket (112), an installation interface is provided to the installation interface plate (103), and an LED bulb (102) is provided to the installation interface; the installation interface plate fixing bracket (112) is connected to a lamp post (108); a lamp housing (101) is provided at the upper part of the installation interface plate fixing bracket (112), a lampshade (113) is provided outside the installation interface plate (103), and the lamp housing (101) matches with the lampshade (113) to form an oval shape.

9. The lamp of claim 8, wherein a wire harness connector (106) is provided to the installation interface plate fixing bracket (112), and the wire harness connector (106) is used for connecting a plurality of LED bulbs (102) to a power supply and a control circuit;

wherein the installation interface plate fixing bracket (112) comprises a sleeve (116), the sleeve (116) is used for installing a lamp post (108), wire harness connector brackets (107) are provided on both sides of the sleeve (116), and the wire harness connector brackets (107) are used for installing the wire harness connector (106); a ring plate (114) is provided outside the sleeve (116)

and the wire harness connector brackets (107), and the ring plate (114) is used for fixedly connecting an installation interface plate (103) to the installation interface plate fixing bracket (112);

wherein a light penetration hole and a water drainage hole are provided to the lampshade (113); the installation interface includes a surface in contact with the LED bulb (102) and a hole connected to the LED bulb on the installation interface plate (103).

10. The of claim 7, wherein the lamp is an LED street lamp, a lamp housing is used as an installation interface bracket structure, the LED street lamp comprises a lamp housing (101) formed by sheet metal via a stamping process, an installation interface is provided to the lamp housing (101), the lamp housing (101) is fixed to a lamp post (108) through a lamp post fixing element, and a decorative cover (103) is provided to the lamp housing (101).

11. The lamp of claim 10, further comprising a wire harness connector (106), wherein the wire harness connector (106) is provided to the decorative cover (103), and the wire harness connector (106) is used for connecting a plurality of LED bulbs (102) to a power supply and a control circuit;

wherein the lamp housing (101) is elliptic, edgefolds for reinforcing the structural strength are provided at inner and outer edges of the lamp housing (101), and the installation interface includes a surface in contact with the LED bulb (102) and a hole connected to the LED bulb on the lamp housing (101);

wherein the lamp post fixing element comprises a lamp post fixing bracket (112), a lamp post fixing bracket bolt (111) and a reinforcing plate (110), the lamp post fixing bracket (112) and the reinforcing plate (110) are provided on upper and lower sides of the lamp housing (101), and the lamp housing (101) is fixed to the lamp post (108) through the lamp post fixing bracket (112) and the reinforcing plate (110).

12. The lamp of claim 7, wherein the lamp is an LED street lamp, the LED street lamp using a lamp housing as an installation interface bracket structure comprises a lamp housing (101) punch-formed by sheet metal; the lamp housing (101) includes a bracket panel folded to multiple pieces, an installation interface is provided to the bracket panel, and an LED bulb (102) is provided to the installation interface; the lamp housing (101) is fixed to a lamp post (108) through a lamp post fixing element.

13. The lamp of claim 12, further comprising a wire harness connector (106), wherein the wire harness connector (106) is provided to the lamp housing (101), and the wire harness connector (106) is used for connecting a plurality of LED bulbs (102) to a power supply and a control circuit;

wherein an edgefold for reinforcing the structural strength is provided at the edge of the lamp housing (101), and the installation interface includes a surface in contact with the LED bulb (102) and a hole connected to the LED bulb on the lamp housing (101); a lamp post fixing hole used for connecting the lamp post (108) is formed in the upper part of the lamp post fixing bracket (112);

wherein the lamp post fixing element includes a lamp post fixing bracket (112), a lamp post fixing bracket bolt (111) and a reinforcing plate (110), wherein the lamp post fixing bracket (112) and the reinforcing plate (110) are provided on upper and lower sides of the lamp housing (101), and the lamp housing (101) is fixed to the lamp post (108) through the lamp post fixing bracket (112) and the reinforcing plate (110); the lamp housing (101) includes three bracket panels which are folded to form an angle, a planar bracket is provided at the lower part of the lamp post fixing bracket (112), and the lamp post fixing bracket (112) is fixed to the bracket panel at the center of the lamp housing (101) from the upper side or the lower side of the lamp housing (101); or, the lamp housing (101) comprises two bracket panels which are folded to form an angle, the lamp post fixing bracket (112) is fixed to the bracket panels provided to form the angle from the upper side or the lower side of the lamp housing (101), and a triangular bracket is provided at the lower part of the lamp post fixing bracket (112) and is inverted V-shaped or V-shaped.

14. The lamp of claim 7, wherein the lamp is an LED street lamp, the LED street lamp comprises a metal extrusion type installation interface bracket (103), the extrusion type installation interface bracket (103) is fixed to a lamp post (108); the extrusion type installation interface bracket (103) includes a lamp post fixing sleeve, bracket panels are provided on both sides of the lamp post fixing sleeve, and an installation interface used for installing an LED bulb (102) is provided to each bracket panel; the LED bulb (102) is installed on the installation interface.

15. The lamp of claim 14, further comprising a wire harness connector (106), wherein the wire harness connector (106) is provided to a lamp post fixing sleeve, and the wire harness connector (106) is used for connecting a plurality of LED bulbs (102) to a power supply and a control circuit;

wherein in the extrusion type installation interface bracket (103), the bracket panels on both sides are provided to form an angle; a lamp post seal head (101) is provided on one end of the lamp post fixing sleeve, and the other end of the lamp post fixing sleeve is fixed to the lamp post (108) through a lamp post fixing screw (109); the installation interface includes a surface in contact with the LED bulb (102) and a hole connected to the LED bulb on the bracket panels.

* * * * *